US012799945B2

(12) United States Patent
Yang

(10) Patent No.: US 12,799,945 B2
(45) Date of Patent: Nov. 17, 2026

(54) NECK FAN

(71) Applicant: SHENZHEN SHIWU TECHNOLOGY CO., LTD, Shenzhen (CN)

(72) Inventor: Xiangyu Yang, Shenzhen (CN)

(73) Assignee: SHENZHEN SHIWU TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 19/410,228

(22) Filed: Dec. 5, 2025

(65) Prior Publication Data

US 2026/0085690 A1 Mar. 26, 2026

Related U.S. Application Data

(63) Continuation-in-part of application No. 18/211,111, filed on Jun. 16, 2023, now Pat. No. 12,504,023, and a continuation-in-part of application No. 19/051,875, filed on Feb. 12, 2025, now Pat. No. 12,514,747.

(30) Foreign Application Priority Data

Jun. 17, 2022 (CN) ..... 202221526916.7
Dec. 17, 2023 (CN) ..... 202323448940.0

(51) Int. Cl.
*F04D 25/08* (2006.01)
*F04D 25/06* (2006.01)

(52) U.S. Cl.
CPC ..... *F04D 25/08* (2013.01); *F04D 25/0673* (2013.01)

(58) Field of Classification Search
CPC ..... F04D 25/08; F04D 29/281; F04D 29/282; F04D 29/30; F04D 29/325; F04D 29/327; F04D 29/329; F04D 29/328; F04D 29/384; F04D 29/386; F04D 29/388; F04D 25/0673
See application file for complete search history.

(56) References Cited

U.S. PATENT DOCUMENTS 6,572,336 B2 * 6/2003 Horng ..... F04D 29/023 416/212 R
7,201,565 B2 * 4/2007 Ku ..... F04D 29/329 416/175
10,202,981 B2 * 2/2019 Lin ..... F04D 17/025
12,560,175 B1 * 2/2026 Zhu ..... F04D 25/166
2021/0324865 A1 * 10/2021 Park ..... F04D 25/084
2021/0355959 A1 * 11/2021 Liu ..... F04D 25/0673
(Continued)

*Primary Examiner* — Bryan M Lettman
(74) *Attorney, Agent, or Firm* — HOWARD M. COHN and Associates, LLC

(57) ABSTRACT

A neck fan configured to be worn around a neck of a user includes a connection member and two fan bodies connected to two opposite ends of the connection member. The connection member is configured to be disposed at a rear side of the neck, and the two fan bodies are configured to be disposed at a front side of the neck. Each fan body includes a body portion and a fan assembly arranged in the body portion. The body portion includes a housing configured to accommodate the fan assembly. The body portion defines at least one air inlet and at least one air outlet, and the fan assembly is configured to intake air from the at least one air inlet and to generate wind, and the wind is capable of flowing out of the neck fan through the at least one air outlet.

7 Claims, 21 Drawing Sheets

(56) References Cited

U.S. PATENT DOCUMENTS

| | | | | |
|---|---|---|---|---|
| 2021/0355960 | A1* | 11/2021 | Liu | F04D 25/0673 |
| 2022/0065258 | A1* | 3/2022 | Liu | A42B 3/286 |
| 2024/0093693 | A1* | 3/2024 | Zhu | F04D 29/703 |

* cited by examiner

NECK FAN

CROSS REFERENCE TO RELATED APPLICATIONS

The present disclosure is a continuation-in-part of U.S. patent application Ser. No. 18/211,111, filed on Jun. 16, 2023, contents of which are incorporated herein by their entireties. The present disclosure is a continuation-in-part of U.S. patent application Ser. No. 19/051,875, filed on Feb. 12, 2025, which claims priority of Chinese pat. application No. CN202323448940.0, filed on Dec. 17, 2023, contents of which are incorporated herein by their entireties.

TECHNICAL FIELD

The present disclosure relates to the field of daily life electronics, and in particular to a neck fan.

BACKGROUND

Fans are commonly used by users to keep cool. In the art, there are many small-sized fans available in the market. Although these fans are small-sized, the fans may not be optimally portable and the airflow generated by the fan may not be comfortable for the user.

SUMMARY OF THE DISCLOSURE

The present disclosure provides a neck fan configured to be worn around a neck of a user. The neck fan includes a connection member and two fan bodies connected to two opposite ends of the connection member. The connection member is configured to be disposed at a rear side of the neck, and the two fan bodies are configured to be disposed at a front side of the neck. Each fan body includes a body portion and a fan assembly arranged in the body portion. The body portion includes a housing configured to accommodate the fan assembly. The body portion defines at least one air inlet and at least one air outlet, and the fan assembly is configured to intake air from the at least one air inlet and to generate wind, and the wind is capable of flowing out of the neck fan through the at least one air outlet, including a body portion, which is being worn around a neck, and a fan disposed at each of two ends of the body portion, wherein each of two ends of the body portion defines a cavity, a side wall of the body portion defines a side air outlet.

When the fan is in use, the connection member is placed on a rear side of the neck, and the two fan bodies is placed on a front side of the body of the user. When the fan bodies are operating, air is delivered to the face or the neck of the user, such that air supply is achieved. In addition, when the neck fan is in use, the neck fan may not be held by any hand, and the user may work with both hands, such that the fan may be applicable in various application scenarios, demands of the user and the market can be met.

DETAILED DESCRIPTION

Figure 1:
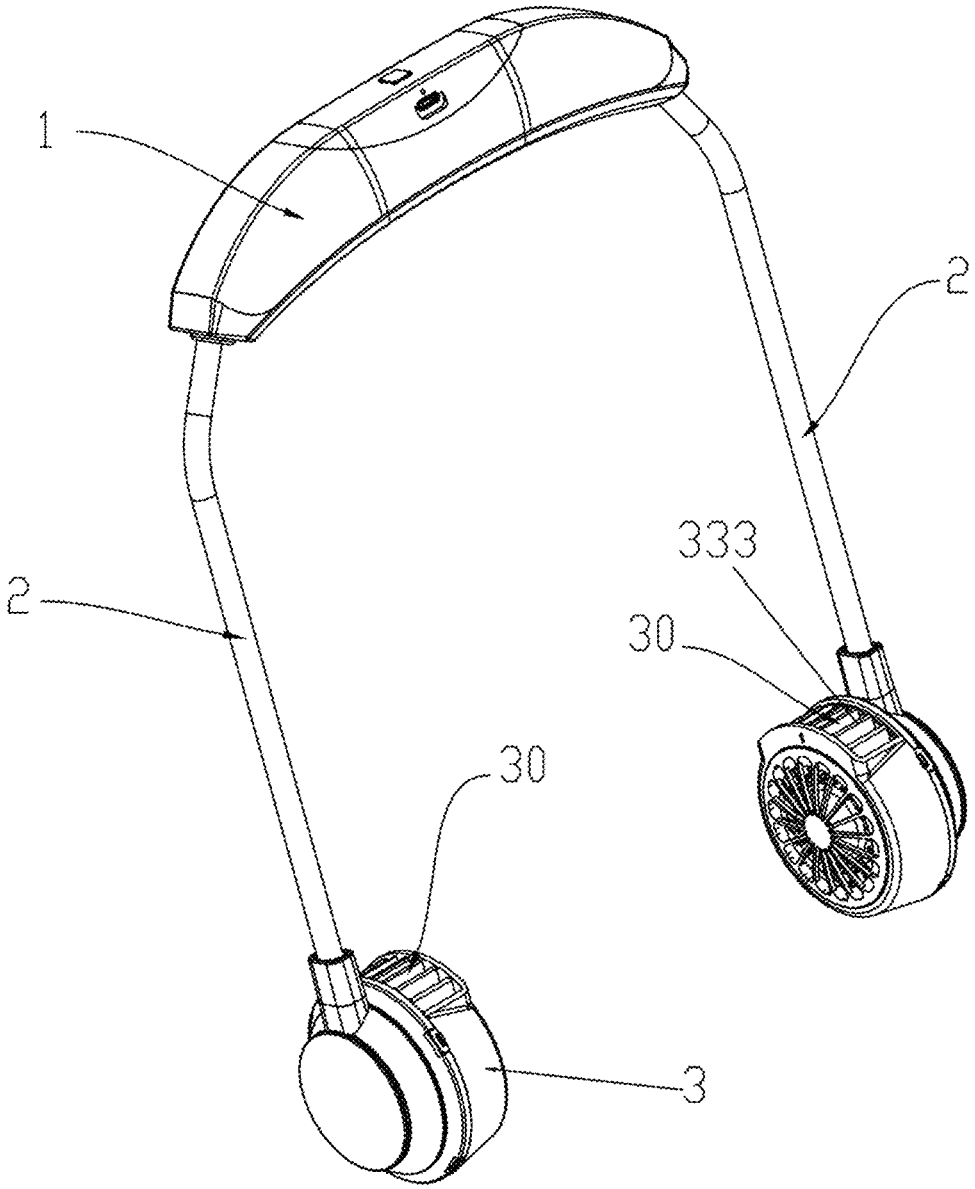
FIG. 1 is a perspective view of the neck fan according to a first embodiment of the present disclosure.
Figure 2:
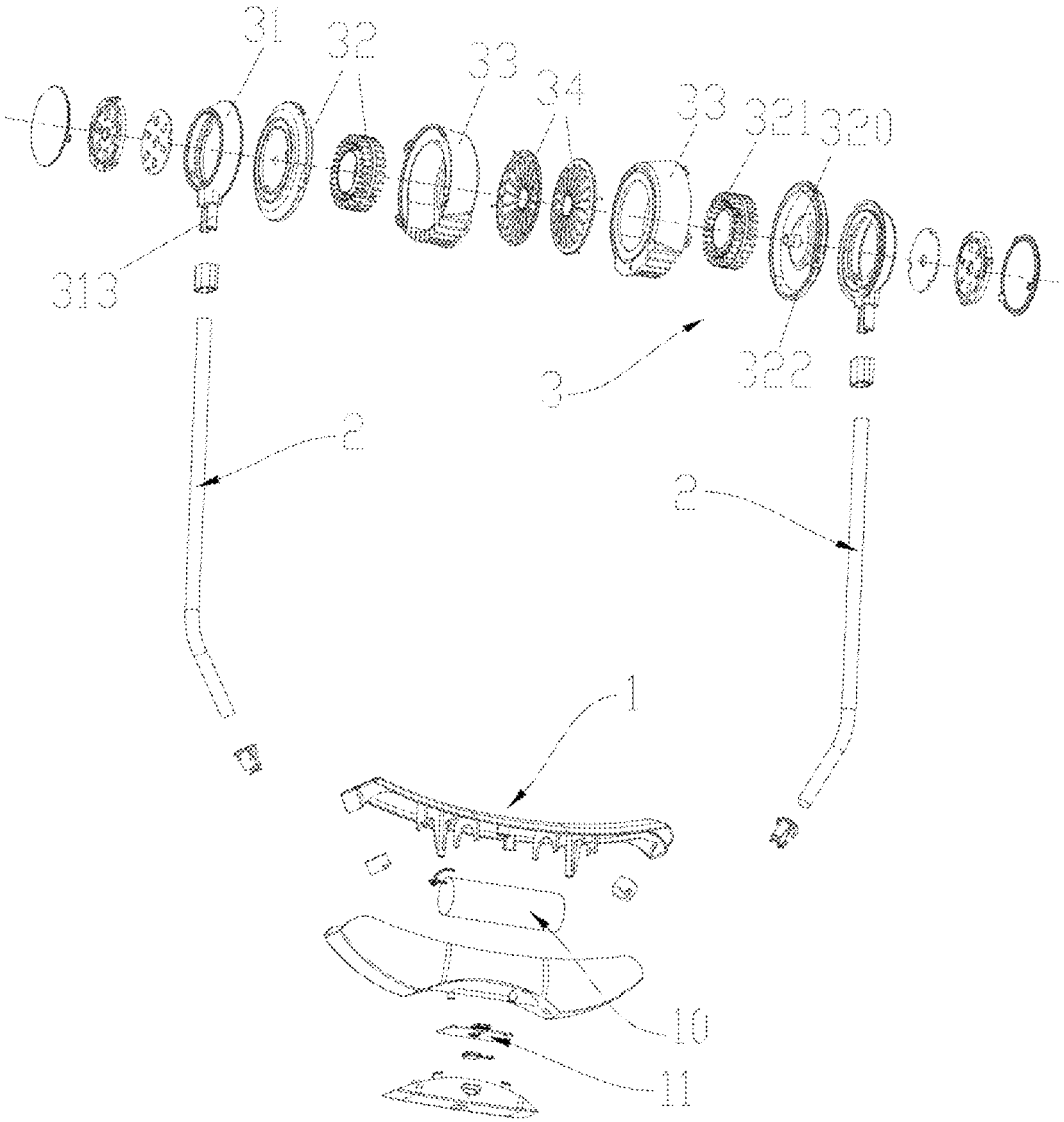
FIG. 2 is an exploded view of the neck fan according to the first embodiment of the present disclosure.
Figure 3:
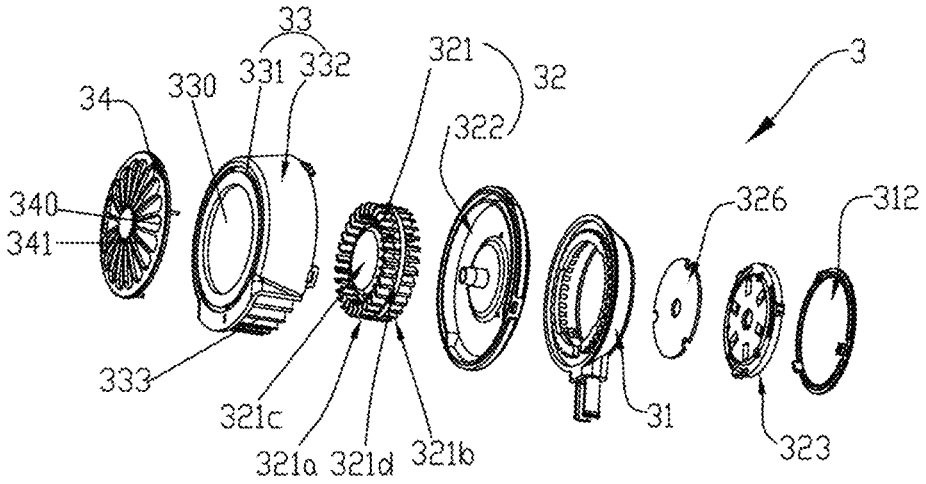
FIG. 3 is an exploded view I of a fan body according to the first embodiment of the present disclosure.
Figure 4:
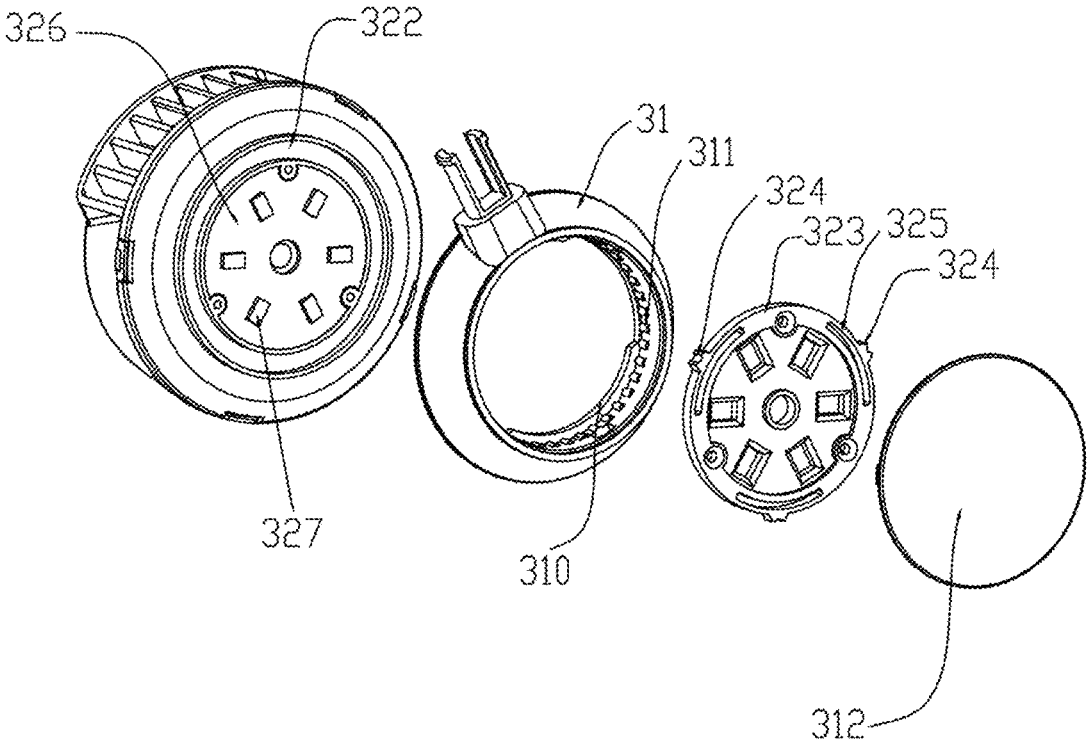
FIG. 4 is an exploded view II of the fan body according to the first embodiment of the present disclosure.
Figure 5:
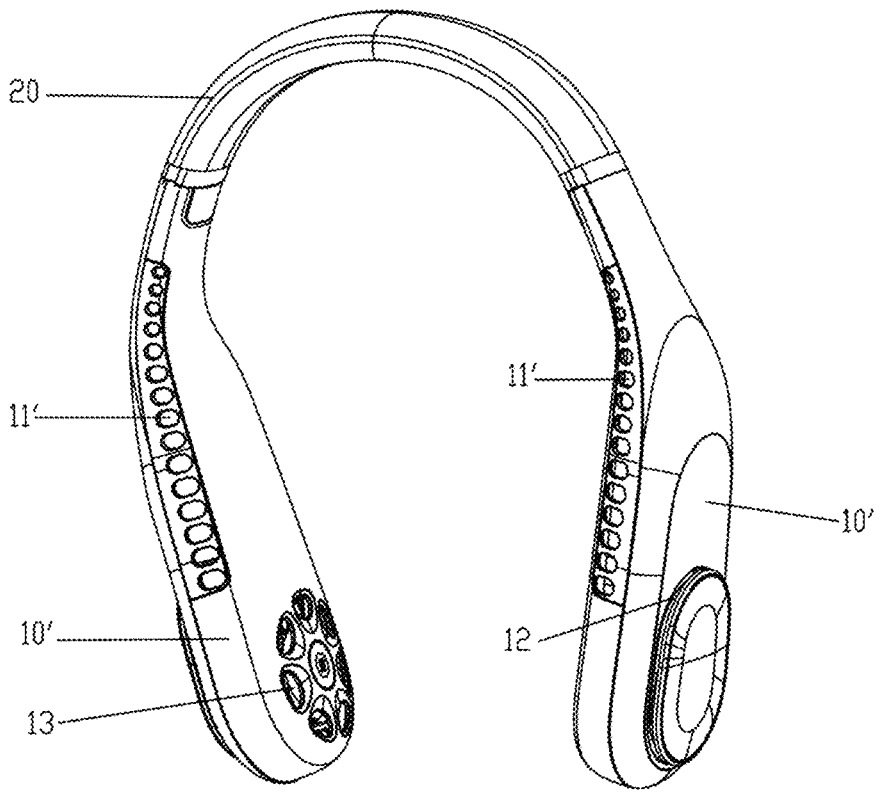
FIG. 5 is a perspective view of a neck fan according to a second embodiment of the present disclosure.
Figure 6:
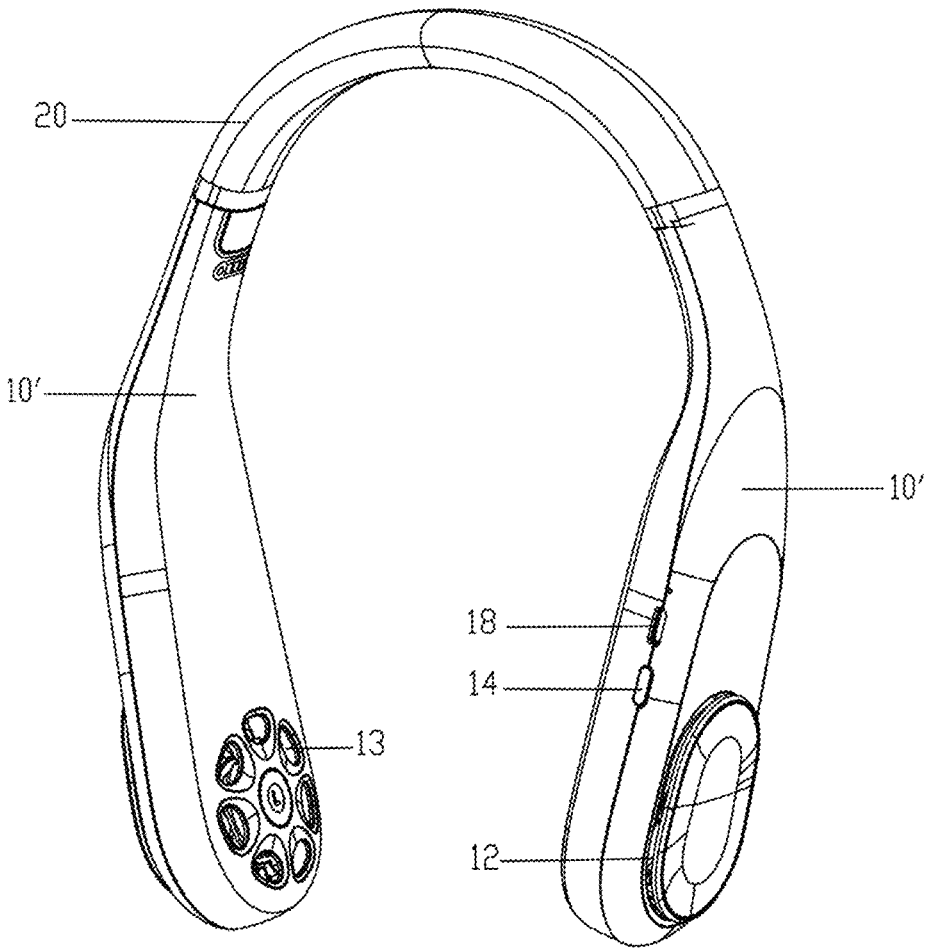
FIG. 6 is another perspective view of the neck fan, viewed from another viewing angle, according to the second embodiment of the present disclosure.
Figure 7:
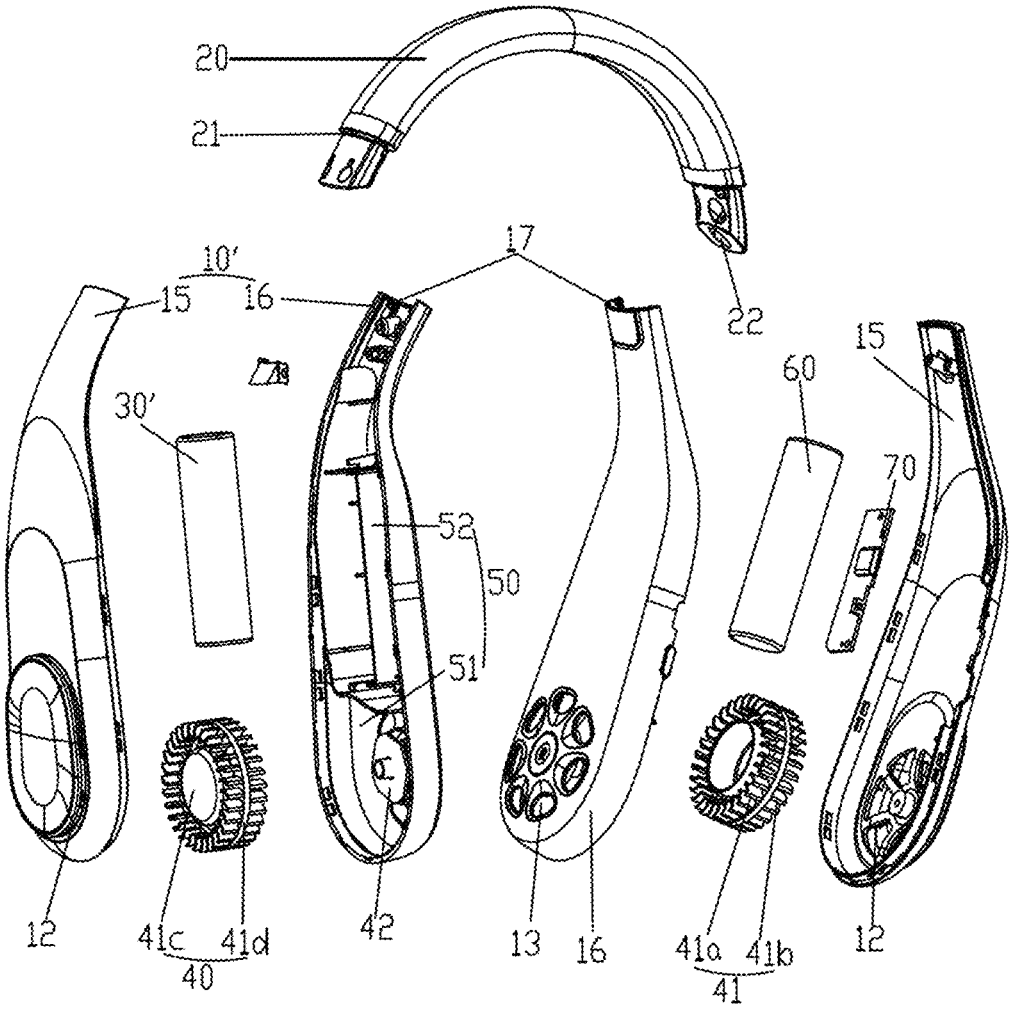
FIG. 7 is an explosive view of the neck fan according to the second embodiment of the present disclosure.
Figure 8:
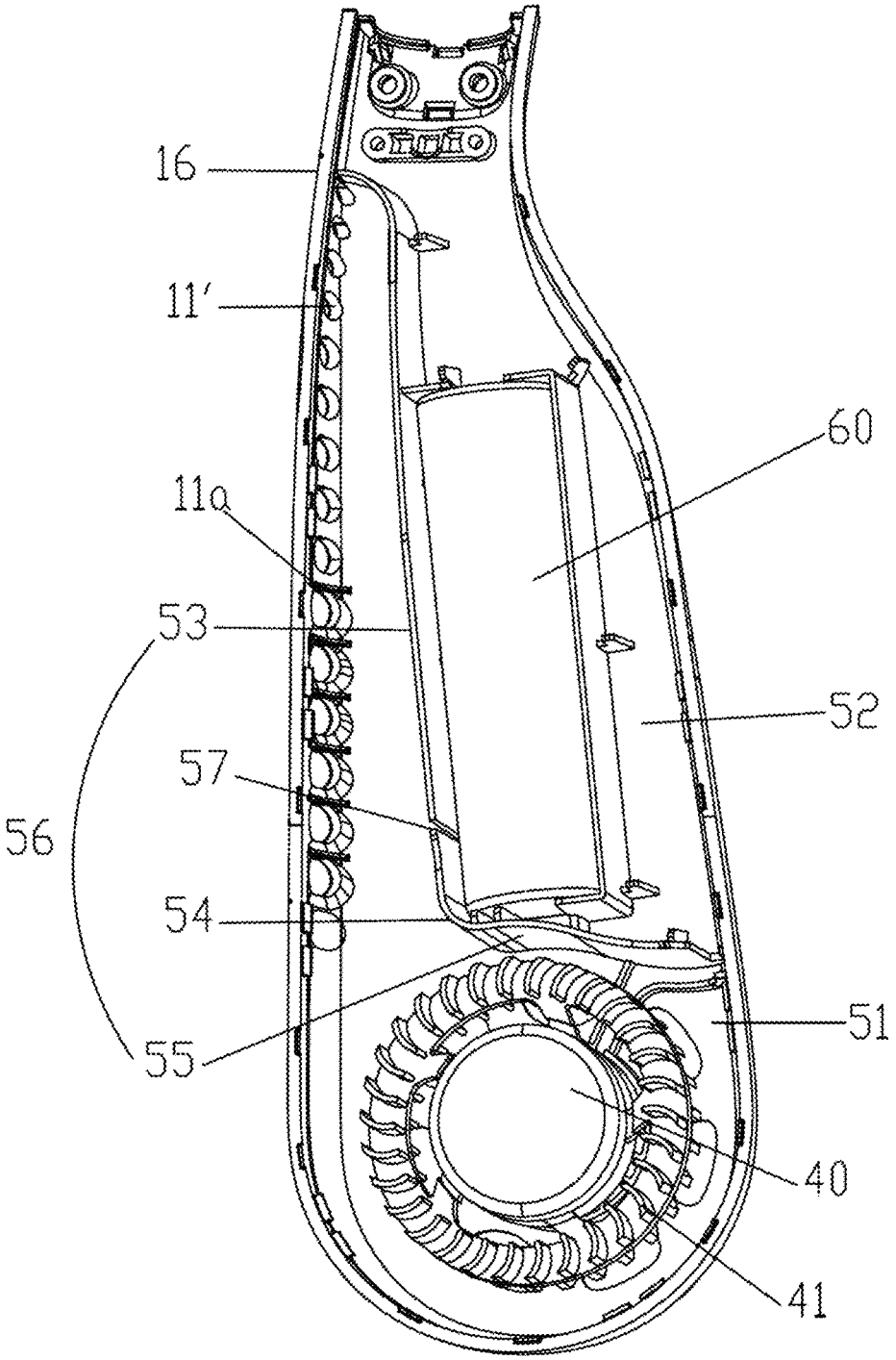
FIG. 8 is a schematic view of an inner structure of a fan body of the neck fan according to the second embodiment of the present disclosure.
Figure 9:
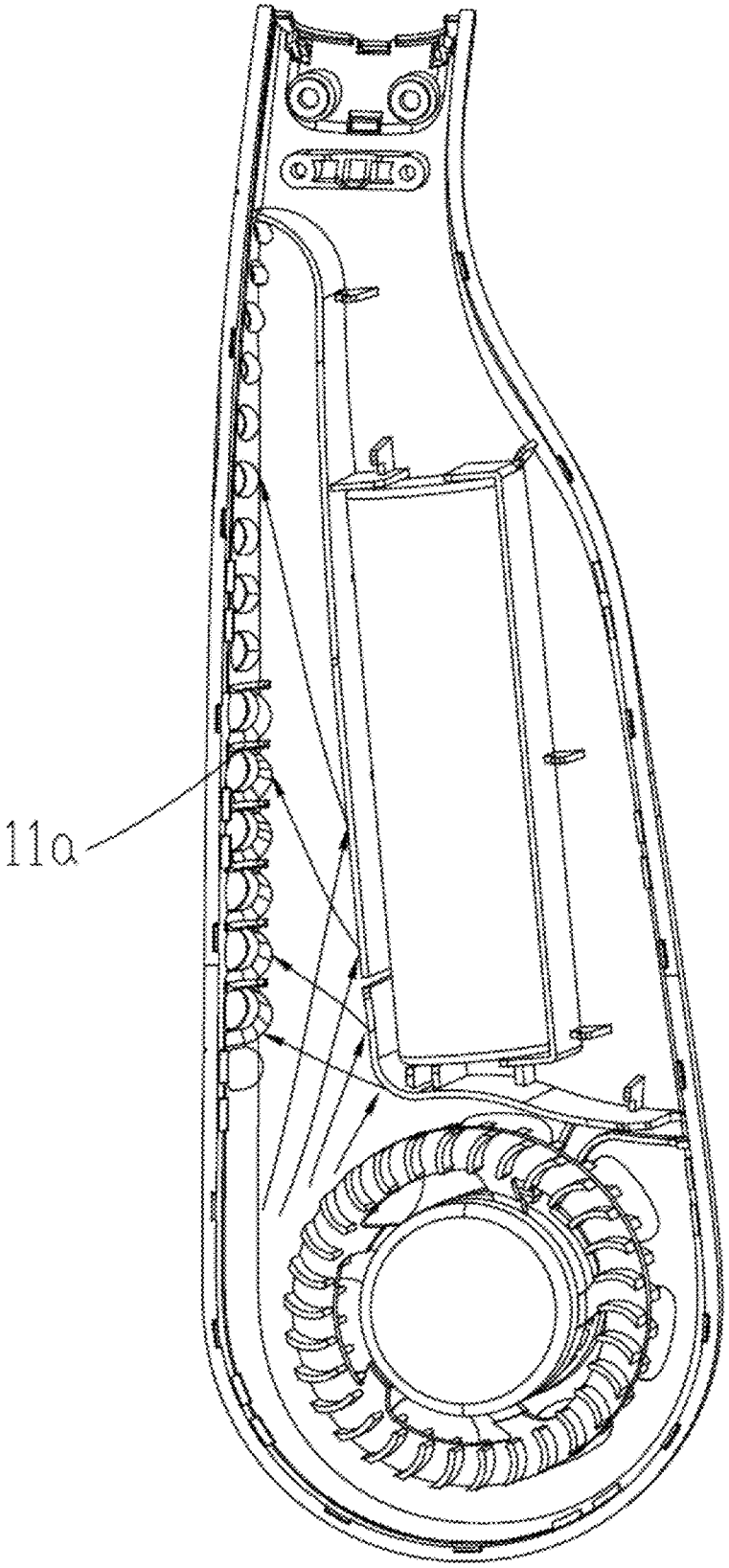
FIG. 9 is a schematic view of a flowing direction of the air after entering the neck fan according to the second embodiment of the present disclosure.

Technical solutions of the embodiments of the present disclosure will be clearly and completely described by referring to the accompanying drawings. Obviously, the described embodiments are only part of the embodiments of the present disclosure. Based on the embodiments in the present disclosure, other embodiments obtained by any ordinary skilled person in the art without any creative work shall fall within the scope of the present disclosure.

The present disclosure provides a neck fan that can be hung around a neck of a user, as shown in FIG. 1 to FIG. 4. The neck fan includes a connection member and two fan bodies connected to two opposite ends of the connection member. The connection member is configured to be disposed at a rear side of the neck, and the fan bodies are configured to be disposed at a front side of the neck. The connection member includes a neck support 1 and two soft connection parts 2 connected to two opposite ends of the neck support 1. The two fan bodies 3 are arranged at lower ends of the two soft connection parts 2 respectively. A side portion of the fan body 3 defines an air outlet 30.

In the neck fan as described in the above, the neck support 1, the two soft connection parts 2, and two fan bodies 3 cooperatively form a structural that can be hung around the neck of the user. When the fan is in use, the neck support 1 is placed at a rear side of the neck, and the two fan bodies 3 hang naturally to a front side of the body of the user. When the fan body 3 is operating, air is delivered to the face or the neck of the user, such that air supply is achieved. In addition, when the fan is in use, the neck fan may not be held by any hand, and the user may work with both hands, such that the fan may be applicable in various application scenarios, demands of the user and the market can be met.

In at least one embodiment, the two soft connection parts and the two fan bodies are symmetrically arranged on two opposite sides of the neck support 1, which is conducive to balancing a center of gravity and is comfortable to wear and is aesthetically pleasing.

In the present embodiment, each fan body 3 includes a body portion and a fan assembly 32 arranged inside the body portion. The body portion includes a bracket 31 and a housing 33. The fan assembly 32 is arranged inside the housing 33. The bracket 31 covers an outer side of the fan assembly 32. An air inlet cover 34 is fixed to the housing 33. The air inlet cover 34 faces towards an air inlet side of the fan assembly 32.

The body portion defines at least one air inlet 11 and at least one air outlet 13 arranged in a different direction with the at least one air inlet. The at least one air inlet is defined on a single side of the body portion to form a single-sided air inlet structure. The fan assembly 32 is configured to intake air from the at least one air inlet and to generate wind, and the wind is capable of flowing out of the neck fan through the at least one air outlet.

The air inlet cover 34 includes a plurality of partition portion and each two adjacent partition portion defines one of the plurality of air inlet 11. In at least one embodiment, the plurality of partition portion is a plurality of guide bars 341 extending along a radial direction of the air intake mesh cover 34. Every two adjacent guide bars 341 define one of the plurality of air inlets 340. Such arrangement can ensure even air intake and reduce noise. The air inlet cover 34 is independently arranged relative to the housing 33 and can be detachably connected to the housing 33, which facilitate maintenance of the air inlet cover 34, such as cleaning the air inlet cover 34. It should be understood that, configuration of the air inlet cover 34 can prevent dust or other items such as hairs from entering the neck fan. In other embodiment, the air inlet cover 34 can be integrally formed with the housing 33. In other embodiment, the air inlet cover 34 can be a honeycomb-shaped plate with a plurality of hexagonal air inlets spaced apart from each other.

In some embodiments, a connection portion 313 arranged at an end of the bracket 31 and is configured to be connected to the soft connection parts 2. For example, the connection portion 313 may be rod shaped. In some embodiments, the bracket 31 and the soft connection part 2 may be a one-piece and integral element.

Further, the fan assembly 32 includes a motor 320, a fan blade assembly 321, and a base 322. The housing 33 is fixedly connected to the base 322. The motor 320 is mounted on the base 322.

In some embodiments, the base 322 is arranged with a shaft, and the motor 320 is arranged on the shaft.

Components of the two fan bodies 3 are symmetrically arranged relative to a perpendicular bisector of the neck support 1. The motor 320 of the fan assembly 32 of each fan body 3 is arranged on a side of the base 322 facing the air inlet cover 34. This arrangement is conducive to further balancing the center of gravity of the neck fan, increasing the wearing comfort and aesthetic appeal.

The fan blade assembly 321 includes a fixing part connected to the motor 320 and a plurality of fan blades arranged around the fixing part. In at least one embodiment, the fan blade assembly 321 includes a first fan blade assembly 321*a* and a second fan blade assembly 321*b*, both of which are arranged around the fixing part.

In some embodiments, the fixing part includes a hub 321*c*, and a connection board 321*d*. The connection board 321*d* is arranged to surround a circumference of the hub 321*c*. The first fan blade assembly 321*a* is arranged on a first side of the connection board 321*d*, the second fan blade assembly 321*b* is arranged on a second side of the connection board 321*d*, and the second side is opposite to the first side. The first fan blade assembly 321*a* includes a plurality of first fan blades arranged at interval and the second fan blade assembly 321*b* includes a plurality of second fan blades arranged at interval. By configuring the first fan blade assembly 321*a* and the second fan blade assembly 321*b*, the blowing force of the neck fan 100 of the present disclosure can be increased, and the cooling effect can be enhanced.

The plurality of first fan blades are spaced apart from each other and are distributed along an edge of the first side, the plurality of second fan blades are spaced apart from each other and are distributed along an edge of the second side. The plurality of first fan blades on the first side are misaligned with the plurality of second fan blades on the second side. Specifically, on a plane where the connection board 321*d* is arranged, an orthographic projection of one of the plurality of first fan blades on the first side is located between orthographic projections of two adjacent blades of the plurality of second fan blades on the second side, and the two adjacent blades are disposed adjacent to the one of the plurality of blades on the first side.

A shape of each of the plurality of first fan blades of the first side is the same as a shape of each of the plurality of second fan blades of the second side. A size of each of the plurality of first fan blades on the first side is the same as a size of each of the plurality of second fan blades on the second side. A thickness of each of the plurality of first fan blades on the first side is the same as a thickness of each of the plurality of second fan blades on the second side.

The hub 321*c* has an end face protruding from the first side of the connection board 321*d*, and ends of the plurality of first fan blades of the first fan blade assembly 321*a* away from the first side of the connection board 321*d* are protruding out of a plane on which the end face of the hub 321*c* is arranged.

In order to adjust an orientation of the air outlet 30 easily, in the present embodiment, the bracket 31 is ring shaped. An inner edge 310 is formed on an inside of the bracket 31. A snap piece 323 is fixed to the base 322. The snap piece 323 is located on the inside of the bracket 31. The inner edge 310 is clamped between the snap piece 323 and the base 322. The snap piece 323, the base 322, and inner edge 310 may operate cooperatively to allow the fan assembly 32 and the housing 33 to rotate relative to the bracket 31.

In an embodiment, a protruding portion 324 is formed at an edge of the snap piece 323. A wavy portion 311 is arranged on an inner wall of the bracket 31. The protruding portion 324 is snapped with the wavy portion 311. When the fan assembly 32 and the housing 33 are rotated to reach a certain position where a preset angle is generated between the fan assembly 32 and the housing 33, the protruding portion 324 and the wavy portion 311 may operate cooperatively to allow the fan assembly 32 and the housing 33 to be fixed at the certain position, such that snapping is achieved.

For example, the housing 33 includes an air inlet portion 331 and a fan covering portion 332. The air inlet cover 34 is connected to the air inlet portion 331. The air inlet portion 331 may define a hole 330, and the air inlet cover 34 may define an air inlet opening, such that the air inlet side of the fan 32 may be communicated with the outside of the neck fan through the hole 330 and the air inlet opening. The neck fan intake air from the outside through the at least one air inlet. Further, when the fan blade assembly 321 is rotating, wind is generated and is output from the circumference of the fan blades. The fan covering portion 332 covers the circumference of the fan blades of the fan blade assembly 321 and includes a blocking side and an air outlet side. The blocking side is a solid structure and does not define any opening, such that the wind output from the circumference of the fan blades may hit an inner wall of the housing 33 and cannot be output out of the housing 33 from the blocking side. The air outlet side of the housing 33 defines an opening corresponding to some of the fan blades of the fan assembly 32 and exposing the some of the fan blades of the fan assembly 32, such that the wind generated by the some of the fan blades of the fan assembly 32 can be output from the opening of the air outlet side of the housing 33. In this way, although the entire circumference of the fan blades can generate wind, all the wind can be directed to the opening of the housing and can be output out of the opening of the housing only.

The housing 33 is provided with multiple air outlet side guide vanes 333 spaced apart from each other in the opening. Each air outlet side guide vane 333 extends substantially radially along the fan shell 33, and each two adjacent air outlet side guide vanes 333 define an air outlet 30. The configuration of the multiple air outlets 30 can balance the air flow and make the air flow more gentle.

When rotating the fan assembly 32 and the housing 33, an air outletting direction in which the wind is flowing out of the housing 33 can be adjusted. Regardless of how the air outletting direction is adjusted, the air outletting direction is always substantially perpendicular to the direction in which the air is intaken into the fan. Rotating the fan assembly 32 and the housing 33 allows the angle between an extension direction of the soft connection part 2 and the air outletting direction to be adjusted.

In order to achieve elastic snapping between the protruding portion 324 and the wavy portion 311, in the present embodiment, the snap piece 323 defines an arc-shaped slot 325. The arc-shaped slot 325 extends along the circumference of the snap piece 323, and the protruding portion 324 is aligned with a middle of the arc-shaped slot 325.

The fan assembly 32 is a centrifugal fan assembly, which is configured to intake air from the air inlet 11 and generate wind. The wind is blown out of the neck fan through the air outlet 30. The air outlet direction of the air outlet 30 is different from the air inlet direction of the air inlet 11. In the embodiment shown above, the air outlet direction of the air outlet 30 is approximately perpendicular to the air inlet direction of the air inlet 11. It can be understood that in other embodiments, the air outlet direction of the air outlet 30 can be set according to actual needs. For example, in some embodiments, the air outlet direction of the air outlet 30 can be approximately parallel to the air inlet direction of the air inlet 11. At this time, the air inlet 11 can be arranged on the outer side of the fan housing 33 away from the neck, and the air outlet 30 can be arranged on the inner side of the fan housing 30 facing the neck, and both the air inlet 11 and the air outlet 30 can be arranged in a direction approximately parallel to the axial direction of the fan housing 33. In other embodiments, the air inlet 11 can be arranged on the inner or outer side of the fan housing 33, and the air outlet 30 can be arranged at any position on the side wall of the fan housing 33 connecting the inner and outer sides. At this time, the angle between the air outlet direction of the air outlet 30 and the air inlet direction of the air inlet 11 is greater than 45 degrees and less than or equal to 180 degrees.

In the present embodiment, a light rendering effect is achieved. Specifically, a light plate 326 is fixed to the base 322. The light plate 326 is clamped between the snap piece 323 and the base 322. The light plate 326 is arranged with a plurality of LED chips 327. The snap piece 323 defines a plurality of through holes 328. The plurality of LED chips 327 are aligned to the plurality of through holes 328 in one-to-one correspondence, and each of the plurality of LED chips 327 passes through a corresponding one of the plurality of through holes 328.

In an embodiment, a light-transmitting cover 312 is fixed at the opening of the bracket 31. The light-transmitting cover 312 is located on a side of the bracket 31 away from the base 322. The light-transmitting cover 312 is opposite to the LED chips 327.

In order to achieve power supply and switch control, in the present embodiment, a battery 10 and a circuit board (control board) 11 electrically connected to the battery 10 are arranged inside the main unit 1. A cable is arranged inside the soft connection part 2. The light board 326 and the fan are electrically connected to the circuit board 11 via the cable. In this way, a power state of the light board 326 and the fan is controlled through the circuit board 11. Both the two fan bodies 3 are connected to the circuit board 11 through cables and are controlled for on-off by the circuit board 11. This arrangement simplifies the structure and reduces costs.

In an embodiment, the soft connection part 2 is a flexible tube. Two ends of the soft connection part 2 are fixedly connected to the main unit 1 and the bracket 31 respectively. The soft connection part 2 can change its shape arbitrarily, thereby allowing adjustment of the air outlet angle of the air outlet 30. By connecting through the soft connection part 2 other than using a hinge connection, the structure is simple, the cost is low, and the adjustment of any air outlet angle can be easily achieved.

The above description shows only preferred embodiments of the present disclosure and is not intended to limit the present disclosure. Any modification, equivalent replacement or improvement made within the technical scope of the present disclosure shall be included in the scope of the present disclosure.

Embodiment II

As shown in FIG. 5 to FIG. 9, a second embodiment of the present disclosure provides a neck fan including a connection member 20 and two fan bodies connected to two opposite ends of the connection member 20. The connection member 20 is configured to be disposed at a rear side of the neck, and the fan bodies are configured to be disposed at a front side of the neck.

In the neck fan as described in the above, the connection member 20 and the two fan bodies cooperatively form a structural that can be hung around the neck of the user. When the neck fan is in use, the connection member 20 function as a neck support that is placed on a rear side of the neck, and the two fan bodies are placed on a front side of the body of the user. When the fan bodies are operating, air is delivered to the face or the neck of the user, such that air supply is achieved. In addition, when the neck fan is in use, the fan may not be held by any hand, and the user may work with both hands, such that the fan may be applicable in various application scenarios, demands of the user and the market can be met.

In at least one embodiment, the two fan bodies are symmetrically arranged on two opposite sides of the connection member 20, which is conducive to balancing a center of gravity and is comfortable to wear and is aesthetically pleasing.

In the present embodiment, each fan body includes a body portion and a fan assembly arranged inside the body portion. The body portion includes a housing 10'. The fan assembly is arranged inside the housing 10'.

The body portion defines at least one first air inlet 12 and at least one first air outlet 11' arranged in a different direction with the at least one first air inlet 12. The at least one first air inlet 12 can be defined on a single side of the body portion to form a single-sided air inlet structure. In other embodiment, at least one second air inlet 13 can be defined on another side of the body portion opposite to the at least one first air inlet 12. The at least one first air inlet 12 together with the at least one second air inlet 13 forms a two-sides air inlet structure. The fan assembly is configured to intake air from the at least one air inlet (the at least one first air inlet and/or the at least one second air inlet 13) and to generate wind, and the wind is capable of flowing out of the neck fan through the at least one first air outlet 11'.

In at least one embodiment, at least one air outlet guide vane 11*a* are arranged along an extension direction of the housing 10'. Each air outlet guide vane 11*a* is arranged between two adjacent first air outlet 11'. The arrangement of the air outlet guide vane 11*a* is conductive to more even air outlet.

In at least one embodiment, an angle between the at least one air outlet guide vane 11*a* and the sidewall of the housing 10' where the at least one air outlet 11' is located ranges between 45° and 135°. In at least one embodiment, the at least one air outlet guide vane 11*a* is arranged substantially perpendicular to the sidewall of the housing 10' where the at least one air outlet 11' is located.

The body portion defines a cavity 50. A side wall of the body portion defines the first air outlet 11'. A partition 56 is received in the cavity 50. The partition 56 divides the cavity 50 into a first cavity 51 and a second cavity 52. The fan assembly is received in the first cavity 51. The first air outlet 11 is communicated with the first cavity 51. The partition 56 includes a first baffle 55 and a second baffle 53 connected to the first baffle 55, The first baffle 55 is located above the fan, and a length of the first baffle 55 is greater than a half of a diameter of the fan. The first air outlet 11' is defined at a position corresponding to the second baffle 53. An acute angle is formed between the second baffle 53 and the side wall that defines the first air outlet 11'. When the air is output out of the neck fan, wind generated by rotation of fan blades of the fan assembly flows to reach the second baffle 53 and is subsequently sent out of the neck fan through the first air outlet 11'.

Since the wind generated by rotation of the fan blades of the fan is blocked by the second baffle 53 and is subsequently sent out from the side air outlet, strength of the airflow can be reduced. The wind may flow out of the first air outlet 11' more gently, acting like the natural wind. Strength that the wind flows out of the first air outlet 11' to impact on the skin of the user may be reduced, improving the comfort of the user in using the neck fan of the present disclosure for cooling.

Specifically, the angle between the second baffle 53 and the side wall that defines the first air outlet 11' is less than 45 degrees, and preferably, the angle may be 5-15 degrees. In this way, the wind generated by the fan is reflected by the second baffle 53 to be sent out directly from the first air outlet 11'.

In at least one embodiment, a height of the at least one air outlet guide vane 11*a* in the direction perpendicular to the sidewall of the housing where the air outlet guide vane is located gradually decreases along a direction away from the fan assembly. Since a distance between the second baffle 53 and the side wall that defines the first air outlet 11' gradually decrease along a direction away from the fan assembly, the height of the at least one air outlet guide vane 11*a* gradually decrease, which can ensure enough space for airflow from the fan assembly to reach the first air outlet 11'.

In an embodiment, the second baffle 53 defines at least one diversion port 57 to allow the first cavity 51 to be communicated with the second cavity 52. The at least one diversion port 57 is defined at a position corresponding to the first air outlet 11'. The wind generated by the fan assembly passes through the at least one diversion port 57, such that the wind generated by the fan assembly may be dispersed, and the strength of the air flowing out of the first air outlet 11 may be reduced.

In an embodiment, the first baffle 55 is connected to the second baffle 53 by a chamfered corner 54. The wind generated by the fan is blocked by the chamfered corner 54 and is further flowing out of the first air outlet 11.

In an embodiment, in order to allow the wind generated by the fan assembly to reach the second baffle 53, the fan assembly includes a fan blade assembly and a motor 42 connected to the fan blade assembly. A detailed structure of the fan blade assembly is substantially same with those of the fan blade assembly 321. Like the fan blade assembly 321, the fan blade assembly includes a fixing part 40 connected to the motor 42 and a plurality of fan blades 41 arranged around the fixing part 40. The fixing part 40 include a hub 41*c* and a connection board 41*d* arranged around an outer surface of a middle portion of the hub 41*c*. The plurality of fan blades 41 include a first fan blade assembly 41*a* arranged at a first side of the connection board 41*d* and a second fan blade assembly 41*b* arranged on a second side of the connection board 41*d*, both of which are arranged around the fixing part 40. The first fan blade assembly 41*a* includes a plurality of first fan blades arranged at interval and the second fan blade assembly 41*b* includes a plurality of second fan blades arranged at interval. By configuring the first fan blade assembly 41*a* and the second fan blade assembly 41*b*, the blowing force of the neck fan 100 of the present disclosure can be increased, and the cooling effect can be enhanced.

An orthographic projection of one of the plurality of first fan blades in the axial direction of the fan blade assembly is located between orthographic projections of two adjacent blades of the plurality of second fan blades in the axial direction, and the two adjacent second fan blades are disposed adjacent to the one of the plurality of first fan blades. A shape of each of the plurality of first fan blades is the same as a shape of each of the plurality of second fan blades. A size of each of the plurality of first fan blades is the same as a size of each of the plurality of second fan blades. A thickness of each of the plurality of first fan blades is the same as a thickness of each of the plurality of second fan blades.

A cross section of each fan blade of the fan blade assembly is arc shaped. For example, the plurality of first fan blades and the plurality of second fan blades are arranged around a circumference of the fixing part 40. The plurality of first fan blades and the plurality of second fan blades have a same curvature. For one of the plurality of fan blades disposed adjacent to the first baffle 55, a surface of the one of the plurality of fan blades is curved towards a side of the side wall that defines the at least one first air outlet 11'. For one of the plurality of fan blades disposed near side of the side wall that defines the at least one first air outlet 11', a surface of the one of the plurality of fan blades is curved away from the first baffle 55. In some embodiments, the surface of the fan blades may be curved in other ways, as long as the wind generated by the fan assembly can flow towards the second baffle 53.

In an embodiment, in order to improve compactness of the structure of the neck fan, a middle of the first baffle 55 is recessed towards the second cavity 52 to form a curved surface. A curvature of the curved surface is adaptive to a curvature of a circumference of the fan corresponding to the curved surface. Each of the two fan bodies includes a first end connected to the connection member 20 and a second end (distal end) opposite to the first end. A first battery 60 and a circuit board 70 are received in the second cavity 52 at the second end of one of the two fan bodies. The motor 42, the first battery 60, and the fan assembly are electrically connected to the circuit board 70. Two fan assemblies are connected to the single circuit board 70, which is low in cost, simple in operation and production. In at least one embodiment, the circuit board 70 can be arranged in the connection member 20, and both the two fan assemblies are electrically connected to the circuit board 70 through wires, which is conductive to further balance weight of the neck fan. The first battery 60 and the circuit board 70 are received in the second cavity 52, which is separated from the first cavity 51 by the partition 56. Therefore, unwanted water is prevented from entering the second cavity 52 through the first air inlet 12 and the second air inlet 13.

The second end has a first side wall and a second side opposite to the first side wall. The first side walls of the two fan bodies are opposite to each other. The first side wall defines the at least one first air inlet 12 and the second side wall defines the at least one second air inlet 13. The at least one first air inlet 12 and the at least one second air inlet 13 are arranged corresponding to the fan assembly and is communicated with the first cavity 51.

For example, the first baffle 55 includes two ends. One of the two ends is connected to the second baffle 53, and the other one of the two ends is connected to a side of the side wall away from the first air outlet 11'. That is, the first baffle 55 is spaced apart from the fan assembly and extends along and follows at least a part of the circumference of the fan. The second baffle 53 has two ends. One of the two ends is connected to the first baffle 55, and the other one of the two ends is connected to a side of the side wall adjacent to the at least one first air outlet 11'. In an embodiment, the side wall defines the at least one first air outlet 11', distributing along a direction from a side of the side wall adjacent to the fan assembly to a side of the side wall away from the fan assembly. A distribution direction of the at least one first air outlet 11' is the same as an extension direction of the second baffle 53. The number of the at least one diversion port 57 may be one or more. When the at least one diversion port 57 is defined, the diversion port 57 may be defined to correspond to one of the at least one first air outlets 11' adjacent the fan assembly.

In an embodiment, in order to increase a running time length of the neck fan of the present disclosure, a second battery 30, which is electrically connected to the circuit board 70, is received in the second cavity 52 of the other one of the two ends of the body portion. The first battery 60 and the second battery 30 are disposed at the two ends of the body portion, and therefore, weights of the two ends of the neck fan may be balanced.

The housing 10' includes an inner shell 16 and an outer shell 15 connected to the inner shell 16, and the inner shell 16 and the outer shell 15 cooperatively define the cavity 50. The partition 56, the fan, the second air inlet 13, the first air outlet are located on the inner shell 16. The first air inlet 12 is located on the outer shell 15. Each of the two ends of the connection member 20 is provided with a catch 21. Both the inner shell 16 and the outer shell 15 or one of the inner shell 16 and the outer shell 15 is arranged with a protrusion 17. The protrusion 17 is arranged inside the catch 21. The connection member 20 defines a wiring hole 22 communicated with the second cavity 52. The partition 56 and the inner shell 16 may be moulded as a one-piece and integral member. The inner shell 16 may be fixed to the outer shell 15 by a screw, gluing or a snap, and the connection member 20 is fixedly mounted. Specifically, the connection member 20 may be made of soft rubber, such as silicone.

The housing 10' is arranged with a switch button 14 and a charging interface 18 electrically connected to the circuit board 70. The switch button 14 may be pressed to turn on the fan through the circuit board 70. The fan assembly may be connected to the power supply through the charging interface 18, and the first battery 60 and the second battery 30 may be charged through the circuit board 70.

Embodiment III

Referring to FIG. 10 to FIG. 19, a third embodiment of the present disclosure provides a neck fan 100.

Figure 10:
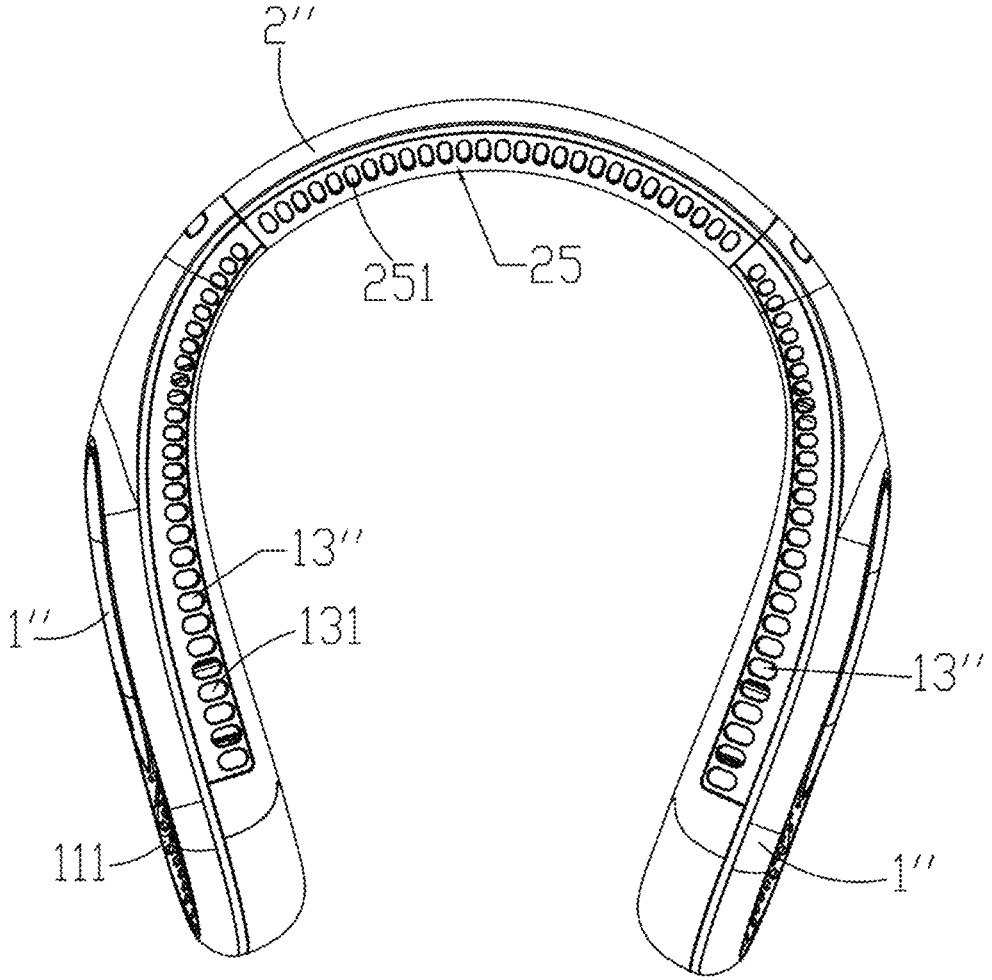
FIG. 10 is a three-dimensional diagram of a neck fan according to a third embodiment of the present disclosure.

Referring to FIG. 10, the neck fan 100 includes a connection member 2" and two fan bodies 1" connected to two opposite ends of the connection member 2". The connection member 2" is configured to be disposed at a rear side of the neck, and the fan bodies 1" are configured to be disposed at a front side of the neck.

In the neck fan as described in the above, the connection member 2" and the two fan bodies 1" cooperatively form a structural that can be hung around the neck of the user. When the neck fan is in use, the connection member 2" function as a neck support that is placed on a rear side of the neck, and the two fan bodies 1" are placed on a front side of the body of the user. When the fan bodies are operating, air is delivered to the face or the neck of the user, such that air supply is achieved. In addition, when the neck fan is in use, the fan may not be held by any hand, and the user may work with both hands, such that the fan may be applicable in various application scenarios, demands of the user and the market can be met.

In at least one embodiment, the two fan bodies 1" are symmetrically arranged on two opposite sides of the connection member 2", which is conducive to balancing a center of gravity and is comfortable to wear and is aesthetically pleasing.

Figure 11:
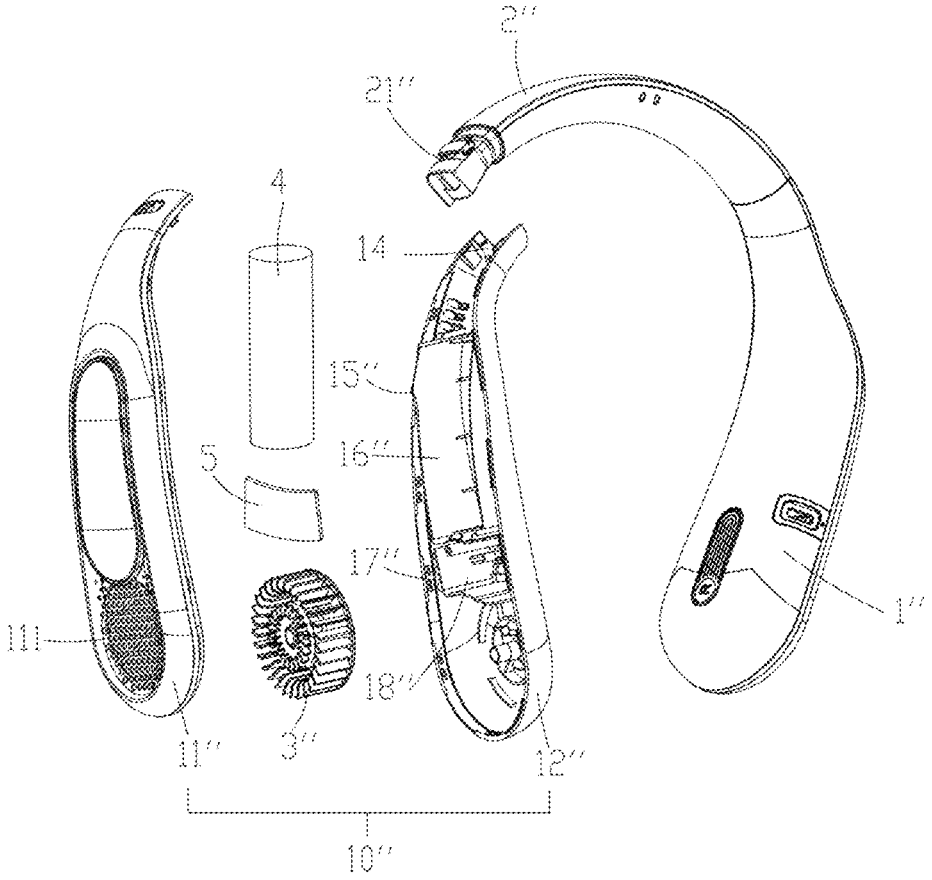
FIG. 11 is a partially exploded view of the neck fan according to the third embodiment of the present disclosure.
Figure 16:
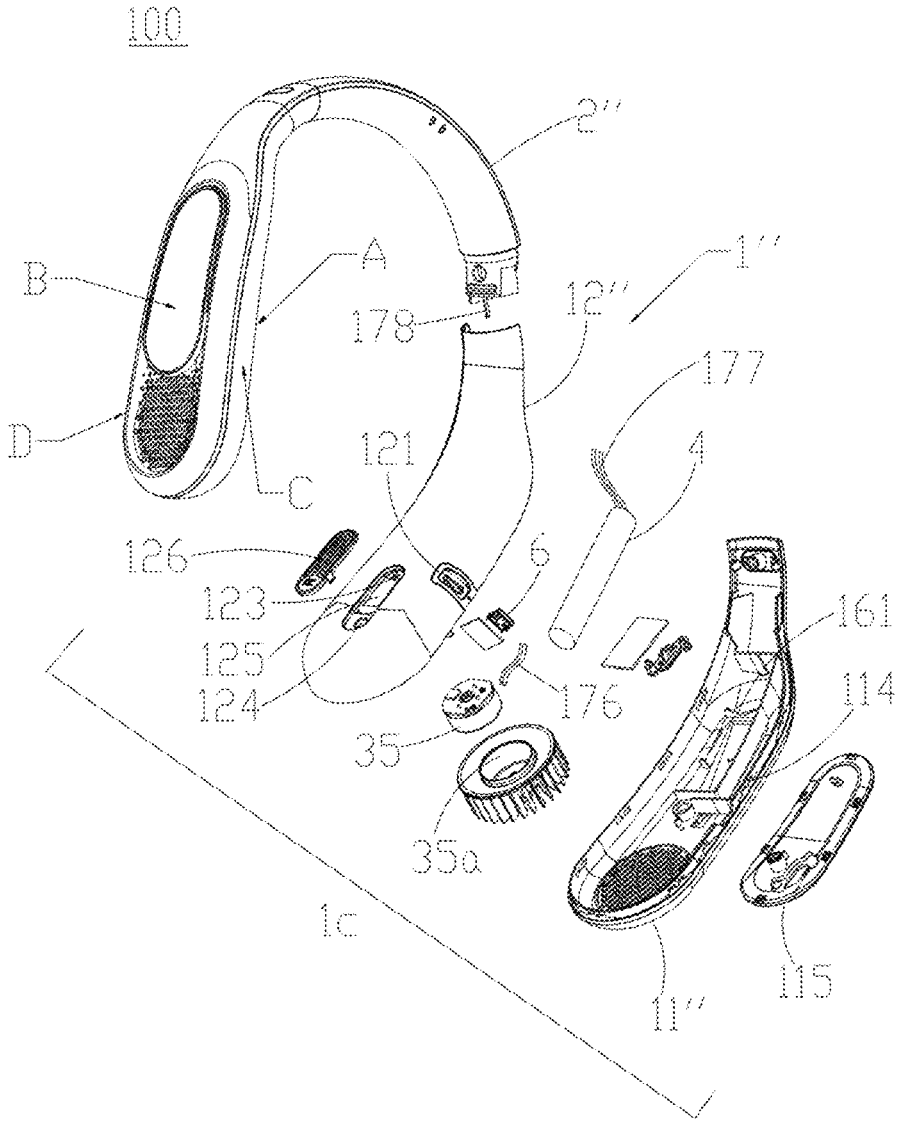
FIG. 16 is a partially exploded view of the neck fan according to the third embodiment of the present disclosure, viewed in another angle.
Figure 17:
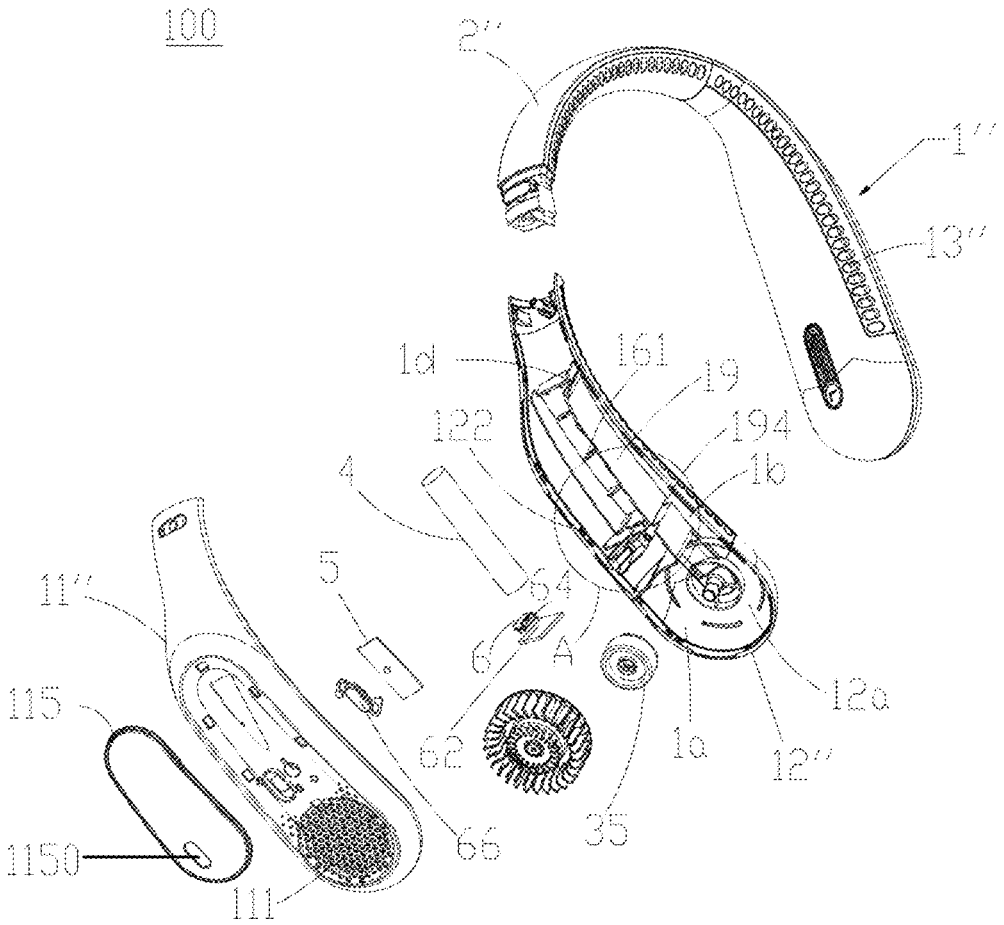
FIG. 17 is a partially exploded view of the neck fan according to the third embodiment of the present disclosure, viewed in still another angle.

In the present embodiment, each fan body 1" includes a body portion and a fan assembly arranged inside the body portion. The body portion includes a housing 10". Referring to FIGS. 11, 16 and 17, the fan assembly is arranged inside the housing 10". The fan assembly includes a motor 35, a fan blade assembly 3", and a base 12*a*. The housing 10" is fixedly connected to the base 12*a*. The motor 35 is mounted on the base 12*a*.

Please referring to FIG. 11, the body portion defines at least one air inlet 111 and at least one first air outlet 13" arranged in a different direction with the at least one air inlet 111. The at least one air inlet 111 is defined on a single side of the body portion to form a single-sided air inlet structure. The fan assembly is configured to intake air from the at least one air inlet 111 and to generate wind, and the wind is capable of flowing out of the neck fan through the at least one first air outlet 13".

Referring to FIG. 11, the neck fan 100 further includes a battery 4 and a circuit board 5 electrically connected to the battery 4. A first enclosure wall 17" that is enclosed to form a first mounting cavity 18" and a second enclosure wall 15" that is enclosed to form a second mounting cavity 16" are provided in the fan body 1". The circuit board 5 is mounted in the first mounting cavity 18", and the battery 4 is mounted in the second mounting cavity 16".

In the present disclosure, the circuit board 5 is mounted through the first enclosure wall 17", and the battery 4 is mounted through the second enclosure wall 15". In raining days, when rainwater falls from the air inlet 111 or the first air outlet 13", the rainwater can be effectively isolated by the first enclosure wall 17" and the second enclosure wall 15", thus preventing the rainwater from wetting the battery 4 and the circuit board 5, playing a waterproof role, and solving the problem of the existing neck fan that the circuit board 5 and the battery 4 easily gets wet if the rainwater or sweat falls into the neck fan from the first air outlet 13".

Figure 13:
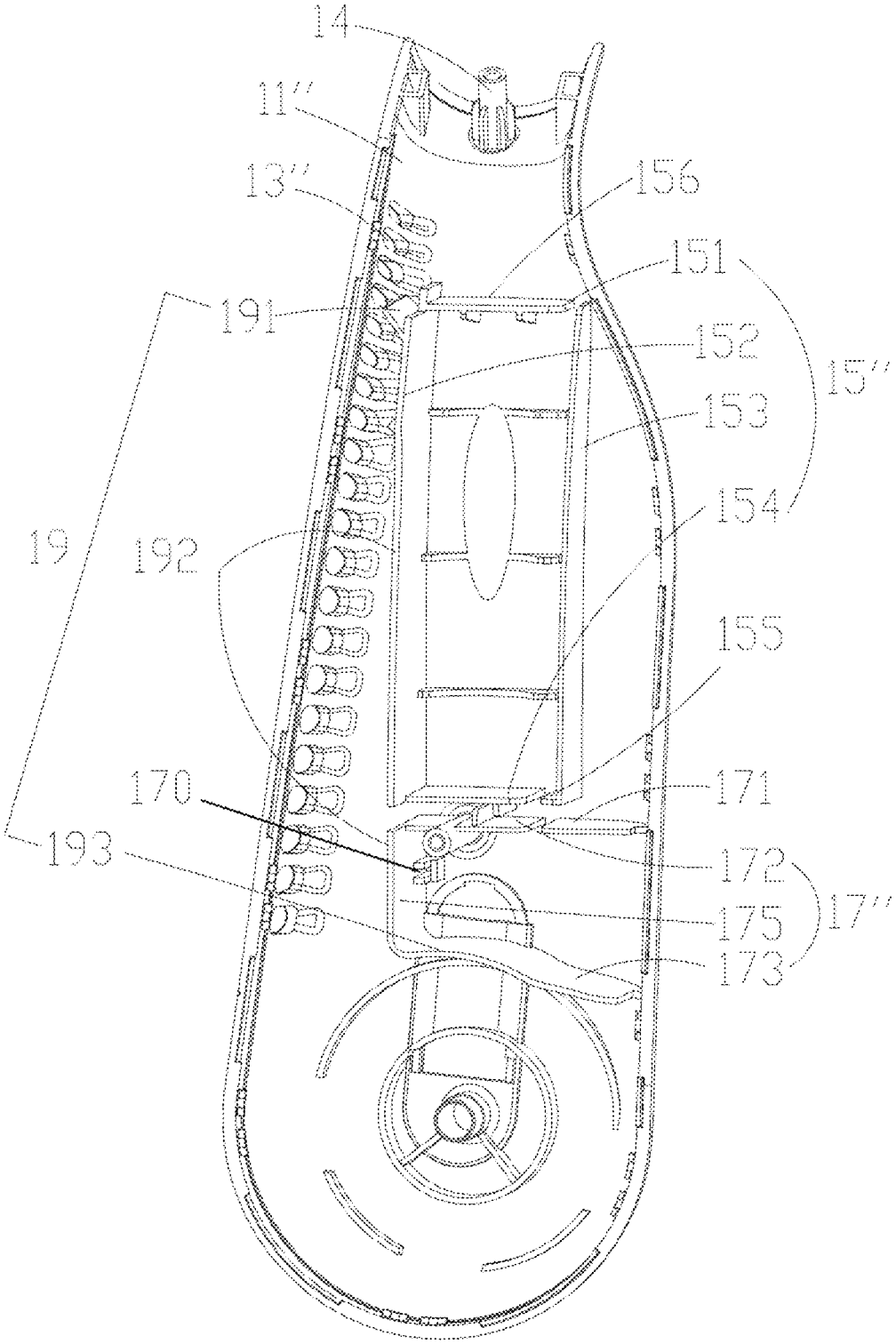
FIG. 13 is a structural diagram showing a second housing of a fan body of the neck fan according to the third embodiment of the present disclosure.
Figure 14:
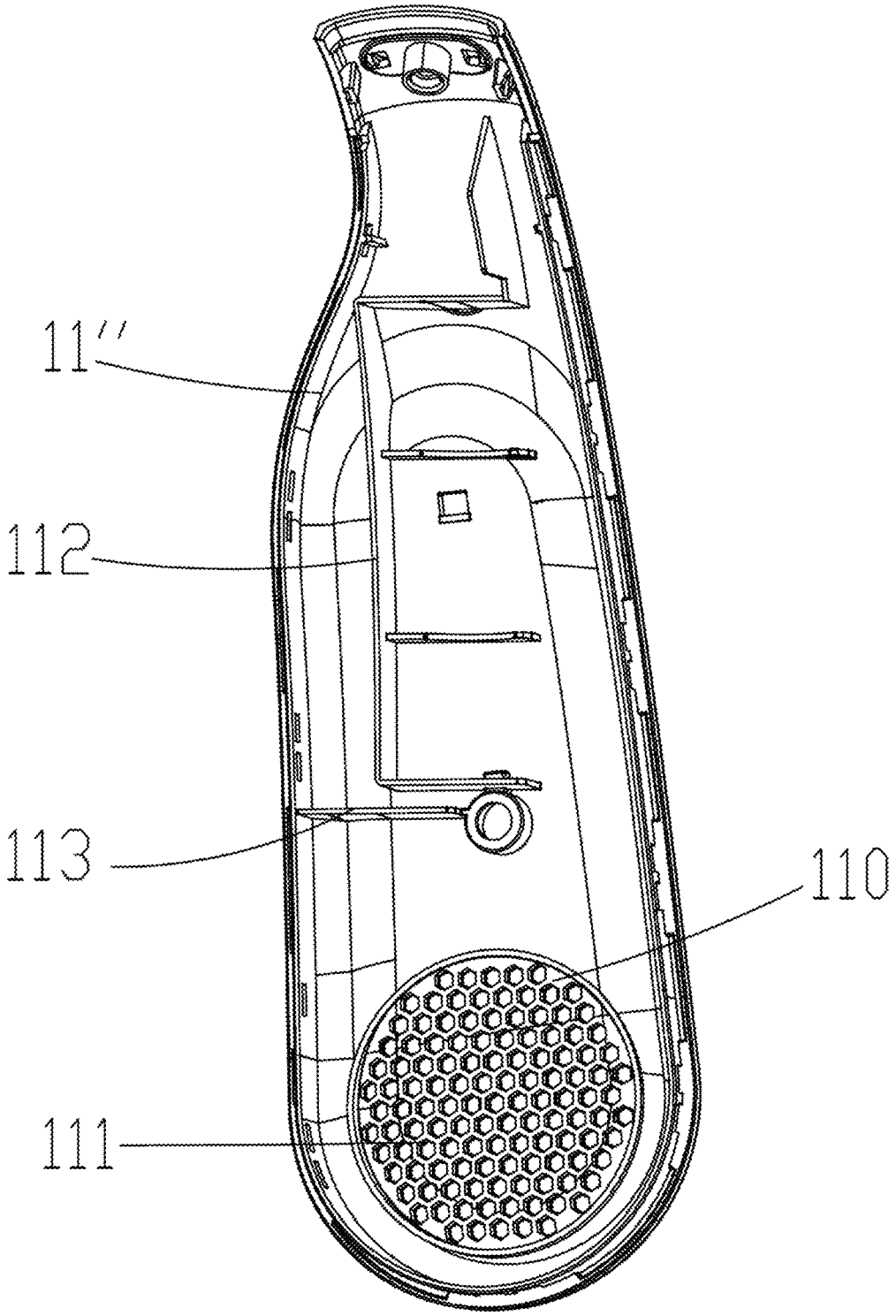
FIG. 14 is a structural diagram of a first housing of the neck fan according to the third embodiment of the present disclosure.

In an embodiment, Referring to FIGS. 13-14, the first enclosure wall 17" is provided with a first wiring slot 171 on a side wall opposite to the second enclosure wall 15", and the first wiring slot 171 is communicated to the first mounting cavity 18". The second enclosure wall 15" is provided with a second wiring slot 155 at a position corresponding to the first wiring slot 171, and the second wiring slot 155 is communicated to the second mounting cavity 16". Through the first wiring slot 171 and the second wiring slot 155, it is convenient to route a first wire 176 electrically connected to the circuit board 5 and the battery 4.

Figure 12:
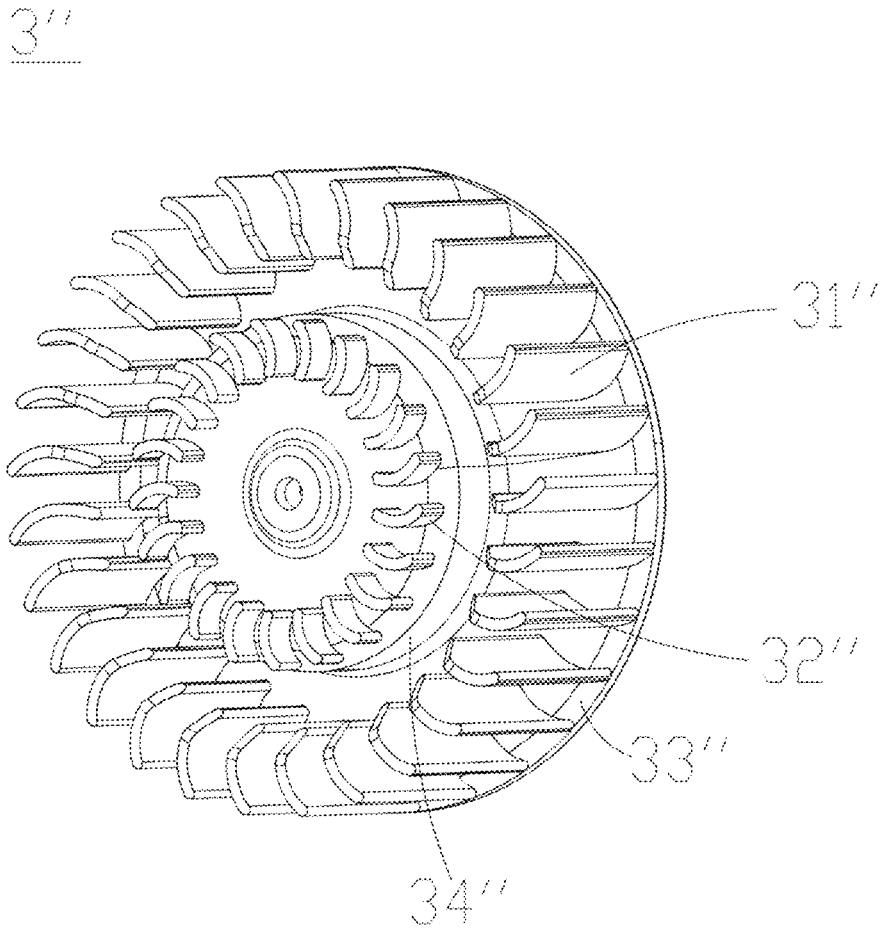
FIG. 12 is a partially structural diagram of a fan blade assembly of the neck fan according to the third embodiment of the present disclosure.
Figure 15:
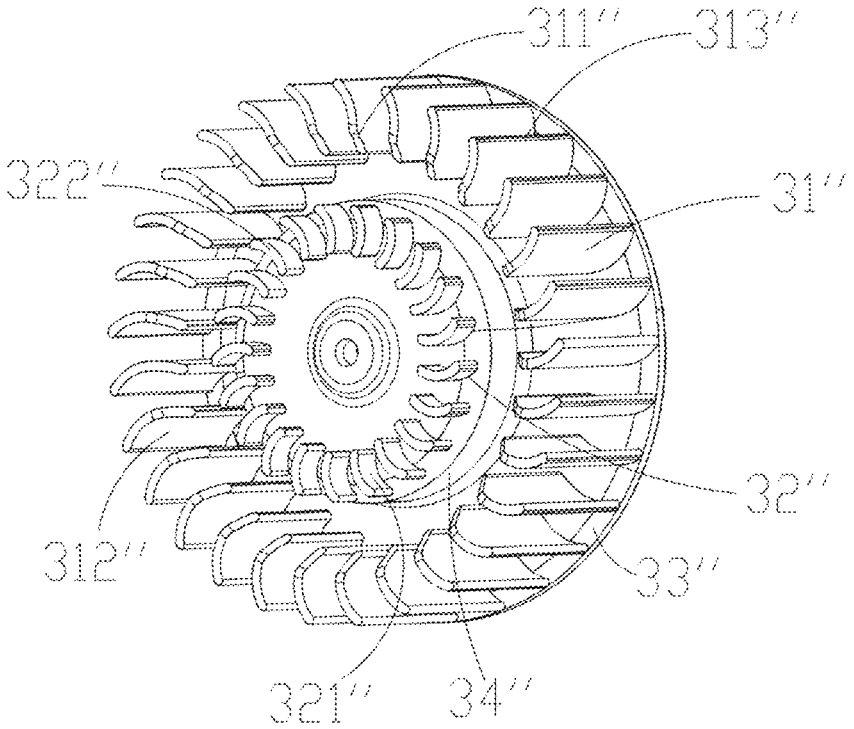
FIG. 15 is a partially structural diagram of the fan blade assembly of the neck fan according to the third embodiment of the present disclosure, viewed in another angle.

Referring to FIGS. 12 and 15, the fan blade assembly 3" includes a fixing part connected to the motor 35 and a plurality of fan blades arranged around the fixing part. In at least one embodiment, the fan blade assembly 3" includes a first fan blade assembly 32" and a second fan blade assembly 31", both of which are arranged around the fixing part.

In some embodiments, the fixing part includes an annular base plate 33" and a boss 34" arranged on the annular base plate 33". The second fan blade assembly 31 is arranged on the annular base plate 33". The first fan blade assembly 32 is arranged on the boss 34". The motor 35 is at least partially arranged inside the boss 34", and a rotating shaft of the motor 35 is connected to the boss 34" to integrate the first fan blade assembly 32 with the second fan blade assembly 31, so that the first fan blade assembly 32 and the second fan blade assembly 31 can be simultaneously driven to rotate when the motor 35 is driven. By configuring the first fan blade assembly 32" and the second fan blade assembly 31", the blowing force of the neck fan 100 of the present disclosure can be increased, and the cooling effect can be enhanced.

In an embodiment, referring to FIG. 12 and FIG. 15, the fan blade assembly 3 electrically connected to the circuit board 5 are arranged at distal ends inside the housings 10" of the two fan bodies 1". The circuit board 5 is located between the fan blade assembly 3 and the battery 4. A honeycomb-shaped air inlet cover 110 is provided in positions, corresponding to the fan blade assembly 3, on an outer side wall of the neck fan 100. The air inlet cover 110 includes a plurality of partition portion and each two adjacent partition portion defines one of the at least one air inlet 11". The first air outlet 13" is communicated to the inside is provided in an inner side of the body portion, and the first wiring slot 171 is located on one side away from the first air outlet 13". Specifically, the air inlet 111 is arranged corresponding to the fan blade assembly 3", which effectively enhances the air supplying effect.

In an embodiment, the at least one first air outlet 13" includes a plurality of air outlets 131. The plurality of air outlets 131 are arranged in a length direction of the neck fan 100, which can effectively increase air discharging directions and enhance the cooling effect when the neck fan is worn at the neck. An air guide plate 19 is arranged inside the housing 10". The air guide plate 19 includes: a first separation section 193 for separating the circuit board 5 from each fan blade assembly 3", a second separation section 192 connected to the first separation section 193 and arranged along a length of the first air outlet 13", and an air guide portion 191 connected to one end of the second separation section 192 away from the first separation section 193 and extending to the first air outlet 13". An air flow generated by the fan blade assembly 3" can be effectively discharged from the first air outlet 13" under the action of the air guide plate 19, thereby enhancing the cooling effect.

In an embodiment, the first enclosure wall 17" includes a first enclosure plate 173, a second enclosure plate 175, and a third enclosure plate 172 which are connected in sequence. The first enclosure plate 173 and the second enclosure plate 175 are spaced apart, and one end of the first enclosure plate 173 and one end of the second enclosure plate 175 are connected to an inner side wall of the housing 10". The first mounting cavity 18" is formed by enclosing the first enclosure wall 17" and the inner side wall of the housing 10". The second enclosure wall 15" includes a fourth enclosure plate 154, a fifth enclosure plate 152, a sixth enclosure plate 151, and a seventh enclosure plate 153 which are connected in sequence. The fourth enclosure plate 154 and the sixth enclosure plate 151 are spaced apart, and one end of the fourth enclosure plate 154 and one end of the sixth enclosure plate 151 are connected to the inner side wall of the housing 10". The first wiring slot 171 is located on the third enclosure plate 172, and the second wiring slot 155 is located on the fourth enclosure plate 154. The first separation section 193 is the first enclosure 173, and the second separation section 192 is composed of the second enclosure 175 and the fifth enclosure plate 152, to effectively reduce structures during the formation of the air guide plate 19. The first wiring slot 171 and the second wiring slot 155 are arranged in sequence in an extension direction of the housing 10".

In the above embodiments, for the compactness of the structure of the present disclosure, the first enclosure wall 17, the second enclosure wall 15, the fan blade assembly 3, the air inlet 111, and the first air outlet 13 are all located inside each housing 10".

It can be understood that each housing 10", and the fan blade assembly 3", the first enclosure wall 17, the second enclosure wall 15, the battery 4, the circuit board 5, and other elements which are located in the housing 10" can constitute the fan body 1". The connection part 2" is a neck support that is configured to be in contact with the neck of a user to hang the housing 10"" around the neck of the user, and the two fan bodies 1" are respectively configured to be arranged on two sides of the neck of the user to blow air towards the user. In some change implementations, the neck support may be omitted, so that the two fan bodies 1" are directly connected.

Each housing 10" includes a first housing 11" and a second housing 12" connected to the first housing 11". A first partition plate 113 and a second partition plate 112 protrude out of and are formed on an inner side wall of the first housing 11", and a third partition and a fourth partition 156 protrude out of and are formed on an inner side wall of the second housing 12". The first partition plate 113 and the third partition plate resist against to form the first enclosure wall 17", and the second partition plate 112 and the fourth partition plate 156 resist against to form the second enclosure wall 15", to effectively play a waterproof role. In this embodiment, the third partition plate is integrated with the third enclosure plate 172.

In an embodiment, a plug-in column 14 protrudes out of and is formed on the inner side wall of the second housing 12", and a plug-in hole 21" is provided in the connection member 2". The plug-in column 14 is inserted into the plug-in hole 21" when the first housing 11" is connected to the second housing 12". By the cooperation between the plug-in column 14 and the plug-in hole 21", the connection member 2" can be connected.

Figure 18:
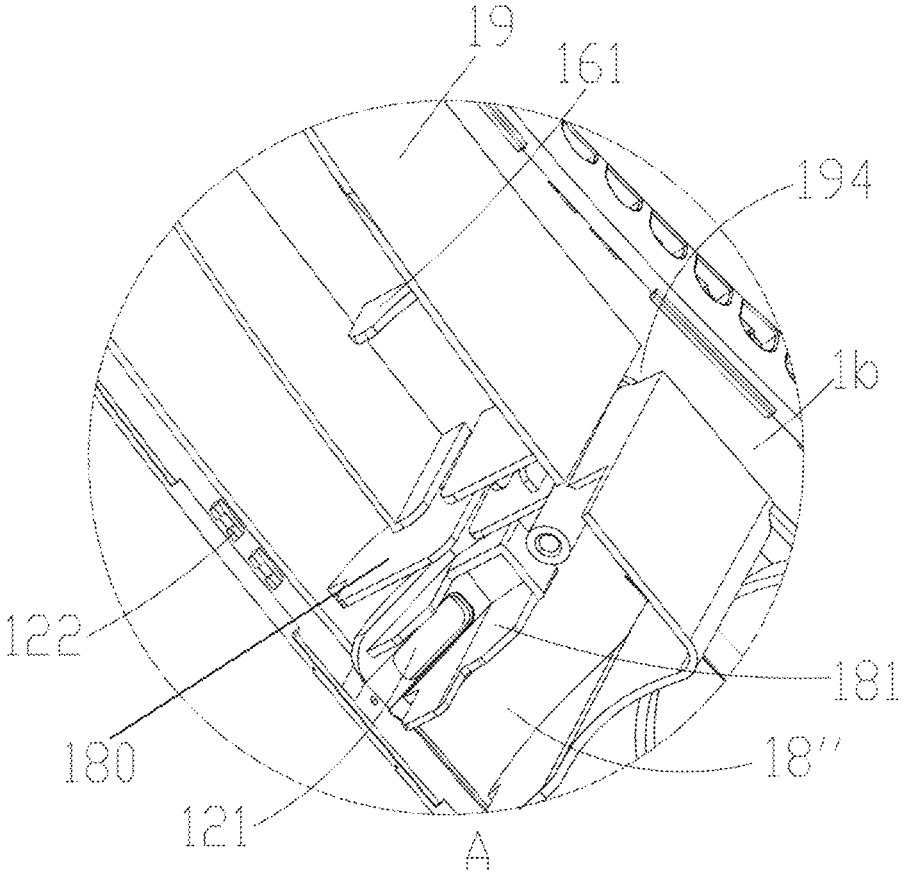
FIG. 18 is an enlarged view of part A in FIG. 17.
Figure 19:
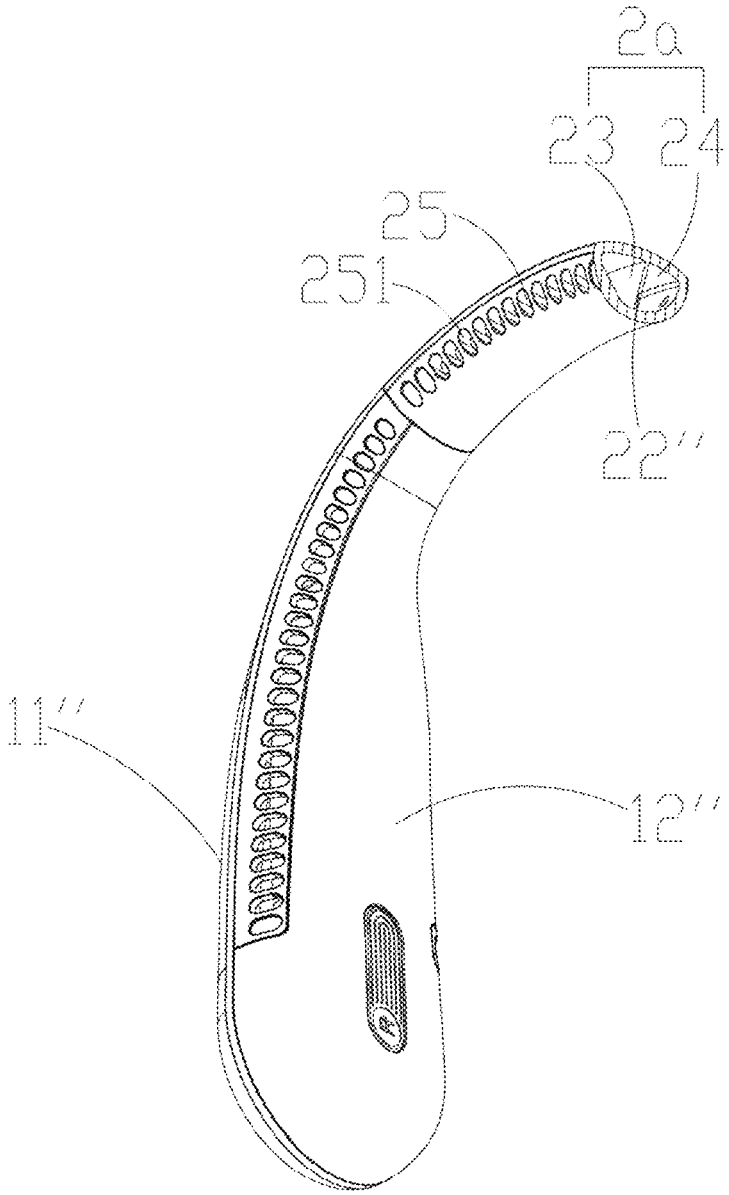
FIG. 19 is a sectional view of a neck support of the neck fan according to an embodiment of the present disclosure.
Figure 20:
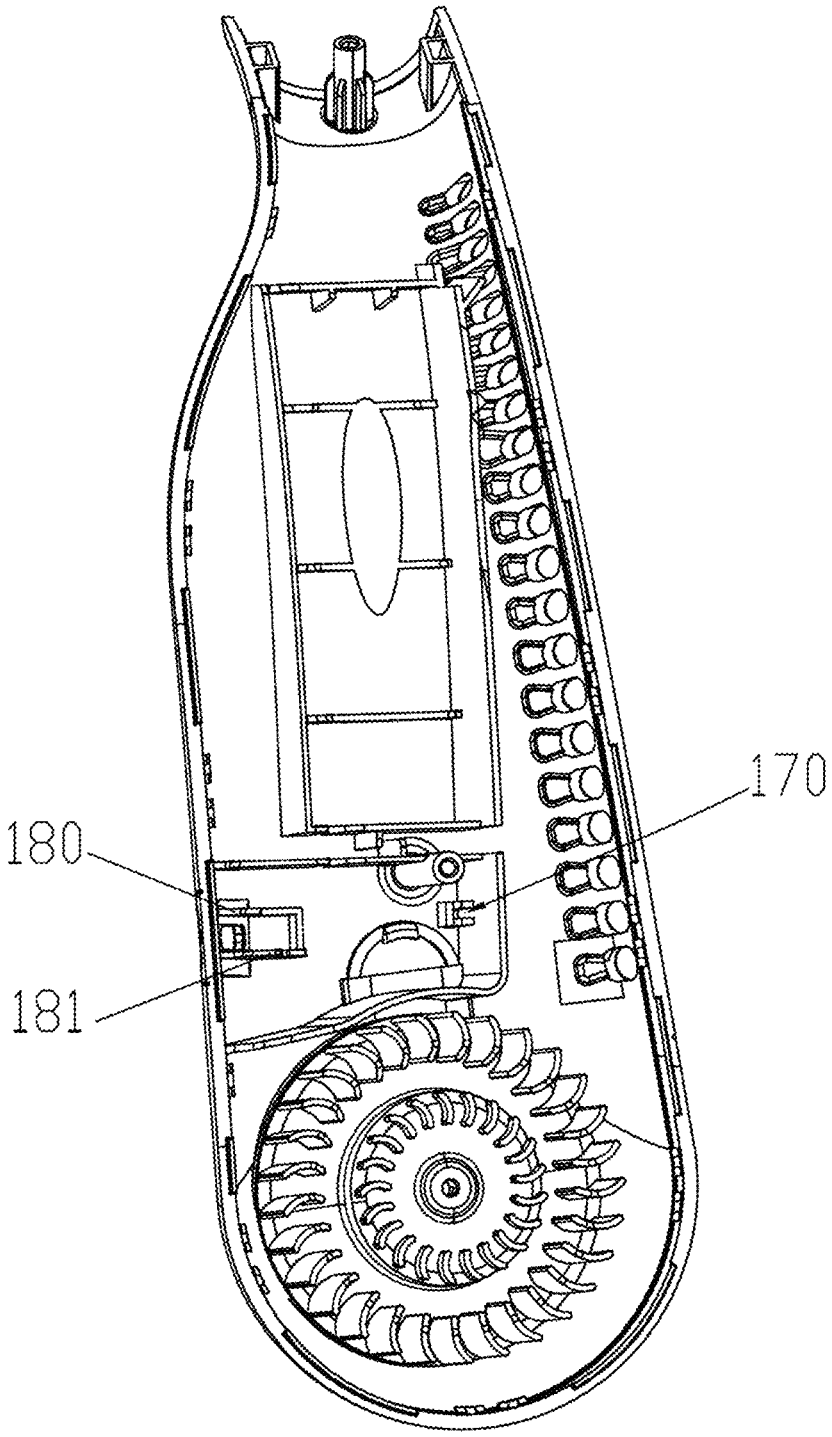
FIG. 20 is a structural diagram showing the second housing of the fan body of the neck fan from another angle according to the third embodiment of the present disclosure.
Figure 21:
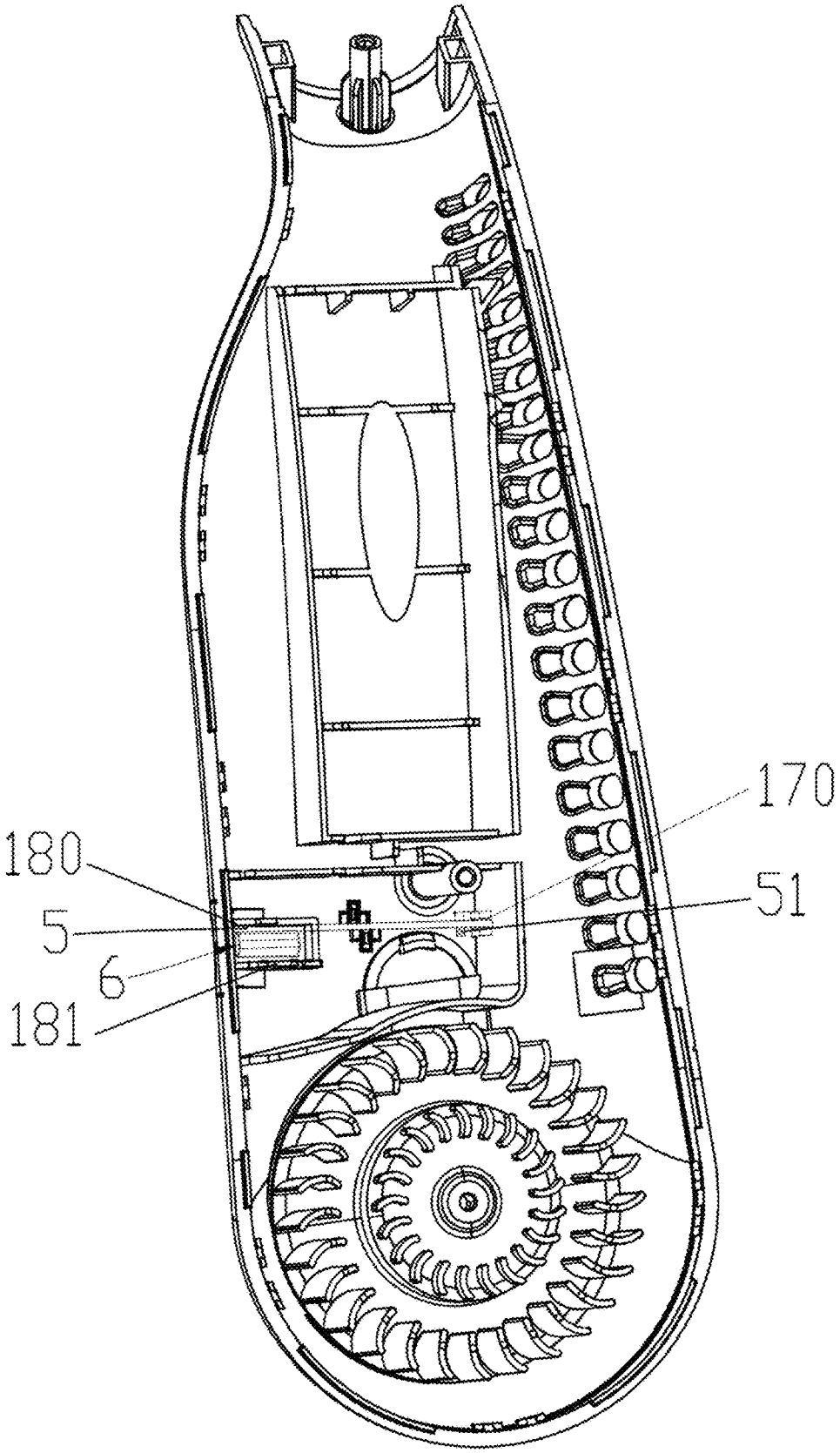
FIG. 21 is a structural diagram showing a circuit board being mounted on the second housing of the fan body of the neck fan according to the third embodiment of the present disclosure.

Referring to FIG. 16, FIG. 17, and FIG. 18, the first housing 11" and the second housing 12" are respectively provided with a first buckle 114 and a second buckle 122. The first buckle 114 and the second buckle 122 are buckled with each other to connect the first housing 11" with the second housing 12". A plurality of first buckles 114 and a plurality of second buckles 122 are provided and are arranged in a one-to-one correspondence manner. In this embodiment, the first buckles 114 are clamping slots or clamping holes provided in the first housing 11", and the second buckles 122 are clamping blocks arranged on the second housing 12". When the first buckles 114 are buckled with the second buckles 122, the clamping blocks are clamped into the clamping slots or clamping holes. In other embodiments, the first buckles 114 may be clamping slots or clamping holes provided in the second housing, and the second buckles 122 may be clamping blocks arranged on the first housing. Alternatively, both the first buckles 114 and the second buckles 122 are hooks or other structures that can achieve interlocking.

Specifically, the first housing 11" and the second housing 12" are connected to form an accommodating cavity 1*a*, and the first mounting cavity 18", the second mounting cavity 16", and a first air duct 1*b* are all located inside the accommodating cavity 1*a*. The battery 4, the circuit board 5, and the fan blade assembly 3" are all arranged in the accommodating cavity 1*a*. To ensure the waterproof effect, the first enclosure wall 17" and the second enclosure wall 15" both resist against inner walls of the first housing 11" and the second housing 12", thereby preventing rainwater and the like from entering the first mounting cavity 18" and the second mounting cavity 16". The first enclosure wall 17" is arranged on at least three sides of the circuit board 5. The second enclosure wall 15" is wound around at least three sides of the battery 4. Two end portions of the air guide plate 19" respectively resist against the inner walls of the first housing 11" and the second housing 12", thereby enclosing the first housing 11" and the second housing 12" to form the first air duct 1*b*. This can reduce the loss of the air flow generated by the fan blade assembly 3", so that the air flow flows out of the first air outlet 13" after passing through the first air duct 1*b*, which enhances the air discharging effect. A decorative sheet 115 is further arranged on one side of the first housing 11" away from the second housing 12", making the appearance of the product neater and more beautiful. The decorative sheet 115 is provided with a button 1150, the circuit board 5 is provided with a press portion 51 corresponding to the button 1150. The button 1150 is configured to be operated to control power on/off of the neck fan 100.

The neck fan 100 provided in this embodiment is configured be worn around the neck of the user.

Referring to FIG. 16 and FIG. 17, the connection member 2" together with the two fan bodies 1" forms a U-shaped structure. In this way, the neck fan 100 can be worn around the neck of the user, facilitating use. Each fan body 1" includes a first side A, a second side B opposite to the first side A, a third side C adjacent to the first side A and the second side B, and a fourth side D adjacent to the third side C.

For ease of understanding and description, the first side A is an inner side for approaching the neck of the user, and the second side B is an outer side arranged in a back-to-back manner with the inner side; at least one air inlet 111 is provided in the second side B; the fourth side D is a bottom side for being in contact with a shoulder of a human body; and the third side C is a top side corresponding to the head of the human body. Specifically, the first housing 11" is located on the second side B of the housing 10", and the second housing 12" is located on the first side A of the housing 10".

In this embodiment, the air inlet 111 is provided in the first housing 11, that is, the air inlet 111 is located on the second side B of the housing 10". When the user wears the neck fan 100 around the neck, the air inlet 111 is located on one side (i.e., the outer side) of the neck fan 100 farther away from the user. This design can not only avoid the hairs from entering the air inlet 111, but also improve the air intake volume and the air intake efficiency, and can avoid air interference caused by the opposite arrangement of the air inlets on two sides when the air inlets are provided in the inner side. Since no air inlet is provided in the second side B of the housing 10", namely, since no air inlet is provided in the second housing 12", the housing 10" forms a single-sided air inlet structure. The air inlet 111 corresponds to the first fan blade assembly 32" and the second fan blade assembly 31", so that the first fan blade assembly 32" and the second fan blade assembly 31" guide air from the air inlet 111 on the single side to the first air outlet 13" for blowing out. This can reduce the adverse effect caused by low air intake efficiency of single-sided air supplying, improve the air intake volume and air intake efficiency of the neck fan, and ensure the blowing force and the air discharging volume, thereby ensuring the air discharging effect and enhancing the cooling effect.

The at least one first air outlet 13" is provided in the second housing 12". Specifically, the first air outlet 13" is provided in the fourth side D of the housing 10". The at least one first air outlet 13" includes a plurality of first air outlets 131. The plurality of first air outlets 131 are arranged in sequence in the extension direction of the second housing 12". In addition, in this embodiment, a second air outlet 25 is provided in the connection member 2". The second air outlet 25 includes a plurality of second air outlet holes 251 arranged in the extension direction of the connection member 2".

Specifically, the base 12*a* for mounting the motor 35 is arranged in the accommodating cavity 1*a*. The housing 10"

further has a first wiring hole 123, a second wiring hole 124, and a third wiring slot 125. The first wiring hole 123 is communicated to the first mounting cavity 18. The second wiring hole 124 corresponds to and is communicated to the base 12*a*. The third wiring slot 125 is arranged on one side of the housing 10"" away from the accommodating cavity 1*a* and is communicated between the first wiring hole 123 and the second wiring hole 124. The third wiring slot 125 is configured to accommodate a second wire 177 electrically connected between the fan blade assembly 3" and the circuit board 5.

The third wiring slot 125 is provided in the first side A and back onto the air inlet 111. The neck fan 100 further includes a decorative cover 126. The decorative cover 126 is mounted corresponding to the third wiring slot 125 and is connected to the housing 10", so that a surface of the first side A of the housing 10" is smoothly connected to an outer surface of the decorative cover 126 after mounting. Specifically, the decorative cover 126 is further provided with a wearing identification (e.g. R and L), where R represents the right side and L represents the left side. For convenience of manufacturing, the wearing identification can be integrally formed with the decorative cover 126, but not limited to the above, and a wearing identification like a sticker can be used too.

The decorative cover 126 is in buckled connection with the housing 10". The decorative cover 126 includes a plurality of hooks. The housing 10" includes a plurality of bayonets. The hooks are clamped to the bayonets. The plurality of bayonets are respectively adjacent and communicated to the first wiring hole 123 and the second wiring hole 124.

In this embodiment, the fan blade assembly 3" is arranged corresponding to the air inlet 111, so that external air is directly driven by the fan blade assembly 3" after passing through the air inlet 111, which shortens an air flowing path. Then, the fan blade assembly 3" pushes the air to generate an air flow, and the air flow flows out through the first air outlet 13", thereby cooling the user. The air inlet 111 is of a single hole structure. A plurality of air inlets 111 are arranged in a honeycomb. In other embodiments, the plurality of air inlets 111 may be arranged in another array. The arrangement of the plurality of air inlets 111 can ensure the air intake volume and reduce the probability of hairs or dust impurities entering the neck fan 100, thereby reducing the failure rate of the product and prolonging the service life of the product.

Referring to FIG. 11 and FIG. 17, in this embodiment, a cross section of the boss 34" and a cross section of the annular base plate 33" in a direction perpendicular to an axis are circular. A central axis of the boss 34" overlaps a central axis of the annular base plate 33", and an axial direction of a rotating shaft of the motor 35 overlaps the central axis. The first fan blade assembly 32" includes a plurality of first fan blades 322" arranged around a preset axial direction, and the second fan blade assembly 31" includes a plurality of second fan blades 313" arranged around the preset axial direction. The first fan blades 322" and the second fan blades 313" are both arc-shaped blades. A length of each first fan blade 322" is less than a length of the second fan blade 313". A bending direction of the first fan blade 322" and a bending direction of the second fan blade 313" are the same. A curvature of the first fan blade 322" is greater than a curvature of the second fan blade 313". A height of the first fan blade 322" in the preset axial direction is less than a height of the second fan blade 313" in the preset axial direction.

Specifically, each second fan blade 313" of the second fan blade assembly 31 has an air outlet surface 312", and the air outlet surfaces 312" of the plurality of second fan blades 313" are arranged in a first direction. The plurality of first fan blades 322" are uniformly arranged on inner sides of the plurality of second fan blades around the central axis. The first fan blade assembly 32" has an air guide surface 321". The air guide surfaces 321" of the plurality of first fan blades 322" are arranged in the first direction, that is, an arrangement direction of the plurality of first fan blades 322" is the same as an arrangement direction of the plurality of second fan blades 313", to reduce the possibility of turbulence generated on the inner sides of the plurality of second fan blades 313" through the plurality of first fan blades 322".

It should be noted that the first direction can be clockwise or counterclockwise. The air outlet surfaces 312" of the plurality of second fan blade assembly 31" are arranged in the first direction, and the air guide surfaces 321" of the plurality of first fan blade assembly 32" are arranged in the first direction.

To enhance the air outlet effect, the air outlet surfaces 312" of the second fan blade assembly 31" are arc-shaped. That is, each second fan blade assembly 31" protrudes to one side and bends to form a curvature. The air guide surfaces 321" of the first fan blade assembly 32" are arc-shaped. That is, each first fan blade 322" protrudes to one side and bends to form a curvature. In this embodiment, the first fan blade assembly 32 and the second fan blade assembly 31 protrude in the same direction, i.e., bend in the same direction, so that air entering the fan blade assembly 3" through the air inlet 111 is further pushed by the first fan blade assembly 32" after entering the second fan blade assembly 31", so that an initial wind speed of the air flow generated by the fan blade assembly 3" is increased, and the blowing force is increased. Meanwhile, the two groups of fan blade assembly also ensure an increase in the air discharging volume, thereby ensuring the air outlet effect and enhancing the cooling effect.

To ensure that the air flow generated by the first fan blade assembly 32" smoothly enters the second fan blade assembly 31" and is further pushed, a height of the boss 34" in an axial direction of the annular base plate 33", namely, in a thickness direction of the annular base plate 33", is less than a height of the second fan blade assembly 31". In this embodiment, a sum of the height of the first fan blade assembly 32" and the height of the boss 34" is roughly equivalent to the height of the second fan blade assembly 31", that is, one end of the first fan blade assembly 32" away from the boss 34" is roughly flush with one end of the second fan blade assembly 31" away from the annular base plate 33". The boss 34" is integrally formed with the annular base plate 33".

In this embodiment, a flow guide portion 311 is arranged at one end of the second fan blade assembly 31" away from the annular base plate 33", and a height of one side of the flow guide portion 311 close to the boss 34" is less than a height of one side of the flow guide portion 311 away from the boss 34". Tilting a top end of one side, close to the boss 34", of the second fan blade assembly 31" can allow a portion of the air flow from the first fan blade assembly 32" to flow along an inclined surface of the flow guide portion 311 under the action of the flow guide portion 311, and the remaining air flow enters the second fan blade assembly 31", thereby reducing the noise of the fan blade assembly 3" and increasing the air discharging volume. Meanwhile, the impact of the second fan blade assembly 31" on an air flow velocity can be reduced, thereby ensuring the air discharging effect.

To facilitate the mounting of the motor 35 and reduce the volume of the product, the boss 34" is further formed with a motor accommodating slot 35*a* on one side away from the first fan blade assembly 32", and the motor 35 is arranged in the motor accommodating slot 35*a*.

Referring to FIG. 16 and FIG. 17, the air guide plate 19 and the housing 10" are enclosed to form the first air duct 1*b*. The first air duct 1*b* is communicated to the first air outlet 13". The fan blade assembly 3" discharges the generated air flow through the first air duct 1*b* from the first air outlet 13", thereby blowing air to achieve cooling.

To take away heat generated by both the battery 4 and the circuit board 5, in this embodiment, an opening 194 is provided in the second separation section 192, which can allow a portion of the air flow in the first air duct 1*b* to flow through the first mounting cavity 18" and the second mounting cavity 16" when passing through the opening 194, to take away the heat generated by both the battery 4 and the circuit board 5 and play a cooling role. Specifically, to make the cooling effect better, the opening 194 is communicated to the first wiring slot 171 and the second wiring slot 155, which allows the air flow to enter the first mounting cavity 18" and the second mounting cavity 16" deeply to directly take away the heat. Meanwhile, if there are water stains inside, the air flow can quickly dry the water stains, to ensure that environments inside the first mounting cavity 18 and the second mounting cavity 16" are dry.

For ease of charging, the housing 10" is provided with a charging port component 6. The charging port component 6 is arranged on the circuit board 5 and is electrically connected to the circuit board 5 for connecting an external power supply to charge the battery 4, so that the neck fan 100 can be carried and used. Specifically, referring to FIGS. 13, 18, 20 and 21, the housing 10" is provided with a clamp slot 170, a first limiting element 180, and a second limiting element 181. The first limiting element 180 and the second limiting element 181 are fixed on the inner wall of the housing 10". In at least embodiment, the first limiting element 180 and the second limiting element 181 are integrally formed on the housing 10". A first end of the circuit board 5 is clamped in the clamp slot 170, and one side of a second end of the circuit board the housing 10" resists against the first limiting element 180. The charging port component 6 is arranged on another side of the second end of the circuit board 5 and resists against the second limiting element 181. Therefore, the second end of the circuit board 5 and the charging port component 6 are limited between the first limiting element 180 and the second limiting element 181. The configuration of the clamp slot 170, the first limiting element 180 and the second limiting element 181 can effectively prevent the circuit board 5 from shaking and moving. This prolongs the service life of the product. The housing 10" is provided with a mounting hole 121 for exposing the charging port component 6. The charging port component 6 is arranged in the mounting hole 121 in a penetrating manner, and the charging port component 6 comprises a main circuit board 62 and a charging port 64, the main circuit board 62 is penetrated in the mounting hole 121 in a direction substantially perpendicular to a surface of the one of the housing 10", and the charging port 64 is exposed at the surface of the one of the housing 10". The mounting hole 121 is communicated to the first mounting cavity 18", and the mounting hole 121 does not overlapped with the first air duct 1*b* along the lengthwise direction of the one of the housing 10". A protective cover 66 is removably connected to the housing 10" and is configured to cover the mounting hole 121 to protect the charging port 64.

In this embodiment, the charging port component 6 is arranged on one of the housings 10", specifically on one of the second housings 12". The batteries 4 at the two ends are electrically connected using a third wire 178. In other embodiments, charging port components 6 may be arranged on the housings 10".

In this embodiment, each battery 4 uses a cylindrical structure, which has a battery top side and a battery bottom side. The battery top side and the battery bottom side are opposite to each other and adjacent to a periphery of the battery 4. To mount battery 4 more stably, a limiting member 161 is arranged in the second mounting cavity 16". The limiting member 161 resists against the battery 4 and cooperates with the second enclosure wall 15" to limit the battery 4 in the second mounting cavity 16", to avoid the battery 4 from shaking or moving, thereby reducing wear and noise. In this embodiment, the second enclosure wall 15" is wound around the periphery of the battery 4. In at least one embodiment, a plurality of limiting members 161 are provided, which respectively resist against the periphery, the battery top side, and the battery bottom side of the battery 4. In other embodiments, the battery 4 may be of a structure in another shape, such as a cuboid structure, and the limiting member 161 may be designed according to the shape and structure of the battery 4, to stably fix the battery 4.

Referring to FIG. 10, to convey the air flow to the second air outlet 25 on the connection member 2", a cavity 2*a* which penetrates through the connection member 2" in a length direction of the neck support is provided in the connection member 2". The cavity 2*a* is communicated to the accommodating cavities 1*a* inside the housings 10" at the two ends. The second air outlet 25 on the connection member 2" is communicated to the cavity 2*a*.

Specifically, a separation plate 22" is arranged inside the connection member 2". The separation plate 22" extends in a length direction of the connection member 2" to divide the cavity 2*a* into a second air duct 23 and a threading cavity 24. The second air duct 23 is communicated to the second air outlet 25 on the connection member 2", and the second air duct 23 is further communicated to the first air duct 1*b*, so that the air flow generated by the fan blade assembly 3" can be conveyed through the first air duct 1*b* to the second air duct 23", and then flow out through the second air outlet 25 on the connection member 2. Specifically, each housing 10" is further provided with the air guide portion 191, which guides the air flow in the first air duct 1*b* to the second air duct 23. The air guide portion 191 is connected to one end of the second enclosure wall 15" away from the first enclosure wall 17", and the air guide portion 191 gradually approaches the first air outlet holes 131 away from the fan blade assembly 3". The threading cavity 24 is configured to thread the third wire 178 electrically connected to electronic devices inside the housings 10" located at the two ends of the connection member 2". Thus, separation of the wire from the air flow is achieved, which avoids mutual impact and ensures the safety of electricity use.

The above embodiments of the present disclosure are merely examples for clearly illustrating the present disclosure, and are not intended to limit the present disclosure. Any obvious variation or change that falls within the substantial spirit of the present disclosure shall be within the scope of the present disclosure

What is claimed is:

1. A neck fan, configured to be worn around a neck of a user, the neck fan comprising:

a connection member; and two fan bodies connected to two opposite ends of the connection member, wherein, the connection member is configured to be disposed at a rear side of the neck, and the two fan bodies are configured to be disposed at a front side of the neck;

each fan body comprises a body portion and a fan assembly arranged in the body portion; the body portion comprises a housing configured to accommodate the fan assembly; and the body portion defines at least one air inlet and at least one air outlet, and the fan assembly is configured to intake air from the at least one air inlet and to generate wind, and the wind is capable of flowing out of the neck fan through the at least one air outlet;

wherein the housing defines a cavity, a L-shaped partition is arranged in the cavity to divide the cavity into a first cavity and a second cavity; the fan assembly is arranged in the first cavity, and a battery and a circuit board are arranged in the second cavity; both the fan assembly and the battery are electrically connected to the circuit board; the at least one air outlet is communicated with the first cavity;

the partition comprises a first baffle and a second baffle connected to the first baffle, there is a distance between the first baffle and the fan assembly, the first baffle extends around part of a circumference of the fan assembly; the at least one air outlet is arranged at a sidewall of the housing facing the second baffle, the sidewall of the housing defining the at least one air outlet together with the second baffle forms an acute angle; and the fan assembly is configured to intake air through the at least one air inlet along an axial direction of the fan assembly to generate the wind, the wind is capable of flowing into the second cavity along the circumference of the fan assembly and the second baffle, and then flowing out from the at least one air outlet;

the housing defines a clamp slot configured to accommodate a first end of the circuit board, the housing further comprises a first limiting element and a second limiting element, a first side of a second end of the circuit board opposite to the first end of the circuit board is configured to resist against the first limiting element, a second side of the second end of the circuit board opposite to the first side of the second end is provided with a charging port component, the second limiting element is configured to resist against the charging port component; the housing defines a mounting hole corresponding to the charging port component, and the mounting hole is configured to expose the charging port component.

2. The neck fan according to claim 1, wherein a connection between the first baffle and the second baffle is a rounded corner; and the first baffle is arc-shaped and protrudes towards the second cavity.

3. The neck fan according to claim 1, wherein the housing comprises a first side facing away the neck, a second side opposite to the first side, and a third side connected between the first side and the second side, the at least one air inlet comprises at least one first air inlet arranged on the first side and corresponding to the fan assembly, and the at least one air outlet is arranged on the third side.

4. The neck fan according to claim 3, wherein a decorative sheet is detachably connected to the housing, the decorative sheet is provided with a button, the circuit board is provided with a press portion corresponding to the button, and the button is configured to be pressed to power on or power off the neck fan.

5. A neck fan, configured to be worn around a neck of a user, the neck fan comprising:

a connection member; and two fan bodies connected to two opposite ends of the connection member, wherein, the connection member is configured to be disposed at a rear side of the neck, and the two fan bodies are configured to be disposed at a front side of the neck;

each fan body comprises a body portion, and a fan assembly arranged in the body portion, and a circuit board electrically connected to the fan assembly; the body portion comprises a housing configured to accommodate the fan assembly and a partition arranged in the housing to divide the housing into a first cavity configured to accommodate the fan assembly and a second cavity configured to accommodate the circuit board; and the body portion defines at least one air inlet and at least one first air outlet, and the fan assembly is configured to intake air from the at least one air inlet and to generate wind, and the wind is capable of flowing out of the neck fan through the at least one first air outlet, wherein a side of the housing facing another fan body of the two fan bodies defines a first wiring hole communicated with the second cavity, a second wiring hole communicated with the first cavity, and a wiring slot arranged between the first wiring hole and the second wiring hole; the wiring slot is configured to receive a wire, the first wiring hole is configured to allow a first end of the wire to pass therethrough to be electrically connected to the circuit board, the second wiring hole is configured to allow a second end of the wire to pass therethrough to be electrically connected to the fan assembly; and a decorative cover is detachably connected to the housing to cover or expose the first wiring hole, the second wiring hole, and the wiring slot;

wherein the partition comprises a first enclosure wall configured to define the second cavity and a second enclosure wall configured to define a third cavity, the third cavity is configured to accommodate a battery electrically connected to the circuit board, the first enclosure wall defines a first wiring slot communicated with the second cavity and the second enclosure wall defines a second wiring slot communicated with the third cavity, the second wiring slot corresponds the first wiring slot to allow a wire to pass through the first wiring slot and the second wiring slot to electrically connect the battery and the circuit board.

6. The neck fan according to claim 5, wherein the first enclosure wall comprises a first enclosure plate, a second enclosure plate, and a third enclosure plate connected in sequence; the first enclosure plate and the third enclosure plate are spaced apart, an end of the first enclosure plate and an end of the third enclosure plate are connected to an inner wall of the housing to define the second cavity; the second enclosure wall comprises a fourth enclosure plate, a fifth enclosure plate, a sixth enclosure plate, and a seventh enclosure plate connected in sequence; the fourth enclosure plate and the sixth enclosure plate are spaced apart, an end of the fourth enclosure plate and an end of the seventh enclosure plate are connected to the inner wall of the housing to define the third cavity; the first wiring slot is arranged on the third enclosure plate and the second wiring slot is arranged on the fourth enclosure plate.

7. A neck fan, configured to be worn around a neck of a user, the neck fan comprising:

a connection member; and two fan bodies connected to two opposite ends of the connection member, wherein, the connection member is configured to be disposed at a rear side of the neck, and the two fan bodies are configured to be disposed at a front side of the neck;

each fan body comprises a body portion, and a fan assembly arranged in the body portion, and a circuit board electrically connected to the fan assembly; the body portion comprises a housing configured to accommodate the fan assembly and a partition arranged in the housing to divide the housing into a first cavity configured to accommodate the fan assembly and a second cavity configured to accommodate the circuit board; and the body portion defines at least one air inlet and at least one first air outlet, and the fan assembly is configured to intake air from the at least one air inlet and to generate wind, and the wind is capable of flowing out of the neck fan through the at least one first air outlet, wherein a side of the housing facing another fan body of the two fan bodies defines a first wiring hole communicated with the second cavity, a second wiring hole communicated with the first cavity, and a wiring slot arranged between the first wiring hole and the second wiring hole; the wiring slot is configured to receive a wire, the first wring hole is configured to allow a first end of the wire to pass therethrough to be electrically connected to the circuit board, the second wiring hole is configured to allow a second end of the wire to pass therethrough to be electrically connected to the fan assembly; and a decorative cover is detachably connected to the housing to cover or expose the first wiring hole, the second wiring hole, and the wiring slot;

wherein the partition comprises an air guide plate, the air guide plate comprises a first separation section arranged between the circuit board and the fan blade assembly, a second separation section connected to the first separation section to form a L-shaped structure, the second separation section together with the sidewall of the housing where the at least one first air outlet is located defines a first air duct, an air guide portion connected to an end of the second separation section facing away from the first separation section and extending towards the air outlet one the housing, and the connection member defines at least one second air outlet, a separation plate is arranged inside the connection member and extends in a length direction of the connection member to divide an inner space of the connection member into a second air duct and a threading cavity, the second air duct is communicated to the second air outlet and the first air duct, and the air guide portion is configured to guide air flow in the first air duct to the second air duct.

* * * * *